US009756992B2

(12) United States Patent
Osborne, Jr.

(10) Patent No.: US 9,756,992 B2
(45) Date of Patent: Sep. 12, 2017

(54) ELECTRONIC RESIDENTIAL TISSUE DISPENSER

(71) Applicant: Charles Agnew Osborne, Jr., Cumming, GA (US)

(72) Inventor: Charles Agnew Osborne, Jr., Cumming, GA (US)

(73) Assignee: VSI Import Solutions, LLC, Alpharetta, GA (US)

( * ) Notice: Subject to any disclaimer, the term of this patent is extended or adjusted under 35 U.S.C. 154(b) by 448 days.

(21) Appl. No.: 13/842,343

(22) Filed: Mar. 15, 2013

(65) Prior Publication Data

US 2014/0263812 A1 Sep. 18, 2014

(51) Int. Cl.
*A47K 10/34* (2006.01)
*A47K 10/36* (2006.01)

(52) U.S. Cl.
CPC ..... *A47K 10/3625* (2013.01)

(58) Field of Classification Search
CPC .... A47K 10/3625; A47K 10/34; A47K 10/36; A47K 10/32
USPC ..... 242/563, 564.3–564.5, 566, 588.3
See application file for complete search history.

(56) References Cited

U.S. PATENT DOCUMENTS

| | | | | |
|---|---|---|---|---|
| 2,930,663 | A | 3/1960 | Weiss | |
| 3,017,131 | A | 1/1962 | Wooster | |
| 3,269,592 | A | 8/1966 | Slye et al. | |
| 3,288,387 | A | 11/1966 | Craven, Jr. | |
| 3,554,456 | A | 1/1971 | Moore | |
| 3,594,611 | A | 7/1971 | Tanner et al. | |
| 3,628,743 | A | 12/1971 | Bastian et al. | |
| 3,858,951 | A | 1/1975 | Rasmussen | |
| 3,917,191 | A | 11/1975 | Graham, Jr. et al. | |
| 4,165,138 | A | 8/1979 | Hedge et al. | |
| 4,378,912 | A | 4/1983 | Perrin et al. | |
| 4,549,664 | A | 10/1985 | Gowan et al. | |
| 4,570,197 | A | 2/1986 | Hakanson et al. | |
| 4,712,461 | A * | 12/1987 | Rasmussen | A47K 10/3643 225/106 |

(Continued)

FOREIGN PATENT DOCUMENTS

| | | |
|---|---|---|
| EP | 0574372 | 12/1993 |
| EP | 1097665 | 5/2001 |

(Continued)

OTHER PUBLICATIONS

International Search Report and Written 6Opinion for related PCT application No. PCT/US2014/019061, mailed Jun. 16, 2014.

*Primary Examiner* — William A Rivera
(74) *Attorney, Agent, or Firm* — Womble Carlyle Sandridge & Rice, LLP

(57) ABSTRACT

An automatic electronic dispenser for dispensing a roll of paper product. A dispenser module drives paper from the roll through a discharge chute at the bottom of the module. A front cover hinged on each side rotates to an open position for loading a paper roll. A back cover enables mounting the electronic dispenser to a vertical surface such as a wall. A paper roll holder is attached to the sides of the dispenser module. A driving roller unrolls the paper from the paper holder in response to a signal from an electronic sensor. A plurality of pressing rollers engages the driving roller as paper is being dispensed along a path between the pressing and driving rollers to a discharge chute.

47 Claims, 22 Drawing Sheets

(56) References Cited

U.S. PATENT DOCUMENTS

| | | | | |
|---|---|---|---|---|
| 4,715,086 | A | 12/1987 | Johanson et al. | |
| 4,826,262 | A | 5/1989 | Hartman et al. | |
| 4,916,613 | A | 4/1990 | Lange et al. | |
| 4,960,248 | A | 10/1990 | Bauer et al. | |
| 4,981,544 | A | 1/1991 | Nordale | |
| 5,031,258 | A | 7/1991 | Shaw | |
| 5,060,877 | A | 10/1991 | Bullivant | |
| 5,131,302 | A | 7/1992 | Watanabe | |
| 5,262,229 | A | 11/1993 | Lampert et al. | |
| 5,441,210 | A | 8/1995 | Hinton | |
| 5,452,832 | A | 9/1995 | Niada | |
| 5,491,013 | A | 2/1996 | Holley | |
| 5,526,973 | A | 6/1996 | Boone et al. | |
| 5,604,992 | A | 2/1997 | Robinson | |
| 5,740,006 | A | 4/1998 | Larkin | |
| 5,781,942 | A | 7/1998 | Allen et al. | |
| 5,857,393 | A | 1/1999 | Kohiayma | |
| 5,868,311 | A | 2/1999 | Cretu-Petra | |
| 5,878,381 | A | 3/1999 | Gemmell et al. | |
| 5,945,910 | A | 8/1999 | Gorra | |
| 5,966,753 | A | 10/1999 | Gauthier et al. | |
| 6,069,354 | A | 5/2000 | Alfano et al. | |
| 6,125,482 | A | 10/2000 | Foster | |
| 6,152,445 | A | 11/2000 | Hirota et al. | |
| 6,179,243 | B1 | 1/2001 | Granger | |
| 6,189,163 | B1 | 2/2001 | Van Marcke | |
| 6,236,953 | B1 | 5/2001 | Segal | |
| 6,250,601 | B1 | 6/2001 | Kolar et al. | |
| 6,317,717 | B1 | 11/2001 | Lindsey et al. | |
| 6,354,533 | B1 | 3/2002 | Jespersen | |
| 6,411,920 | B1 | 6/2002 | McConnell et al. | |
| 6,419,136 | B2 | 7/2002 | Formon et al. | |
| 6,647,242 | B2 | 11/2003 | Gagnon et al. | |
| 6,736,348 | B1 | 5/2004 | Formon et al. | |
| 6,871,815 | B2 | 3/2005 | Moody et al. | |
| 6,915,977 | B2 | 7/2005 | Hanzlik et al. | |
| 6,952,555 | B2 | 10/2005 | Oh et al. | |
| 6,974,783 | B2 | 12/2005 | Akdogan et al. | |
| 7,017,856 | B2 | 3/2006 | Moody et al. | |
| 7,022,764 | B2 | 4/2006 | Murray | |
| 7,044,421 | B1 | 5/2006 | Omdoll et al. | |
| 7,070,203 | B2 | 7/2006 | Fisher et al. | |
| 7,182,289 | B2 | 2/2007 | Moody et al. | |
| 7,213,782 | B2 * | 5/2007 | Osborne et al. | 242/563 |
| 7,296,765 | B2 | 11/2007 | Rodrian | |
| 7,370,824 | B1 * | 5/2008 | Osborne | 242/563 |
| 7,698,980 | B2 | 4/2010 | Morris et al. | |
| 7,783,380 | B2 | 8/2010 | York et al. | |
| 7,821,155 | B2 | 10/2010 | Reinsel et al. | |
| 7,845,593 | B2 | 12/2010 | Formon et al. | |
| 7,946,522 | B2 | 5/2011 | Lewis et al. | |
| 7,963,475 | B2 | 6/2011 | Rodrian | |
| 7,967,235 | B2 | 6/2011 | Forman et al. | |
| 7,980,506 | B2 | 7/2011 | Kling et al. | |
| 7,984,872 | B2 | 7/2011 | Kuehneman et al. | |
| 7,987,756 | B2 | 8/2011 | Lewis et al. | |
| 7,996,108 | B2 | 8/2011 | Yardley | |
| 8,082,827 | B2 * | 12/2011 | Friesen | B26D 1/42 83/337 |
| 8,083,170 | B2 | 12/2011 | Troutman et al. | |
| 8,162,252 | B2 | 4/2012 | Cittadino et al. | |
| 8,177,156 | B1 | 5/2012 | Rinne | |
| 8,229,486 | B2 | 7/2012 | Hellstrom | |
| 8,418,950 | B2 | 4/2013 | Hagleitner | |
| 8,439,293 | B2 | 5/2013 | Hagleitner | |
| 8,448,890 | B2 | 5/2013 | Hagleitner | |
| 8,496,198 | B2 | 7/2013 | Cittadino | |
| 8,544,785 | B2 | 10/2013 | Pelland | |
| 8,600,547 | B2 | 12/2013 | Petersen | |
| 8,698,333 | B2 | 4/2014 | Glasser | |
| 8,763,948 | B1 | 7/2014 | Holowaty | |
| 8,777,149 | B2 | 7/2014 | Goeking et al. | |
| 8,800,415 | B2 | 8/2014 | Osborne | |
| 8,807,475 | B2 | 8/2014 | Rodrian | |
| 2002/0109034 | A1 | 8/2002 | Moody et al. | |
| 2002/0109035 | A1 | 8/2002 | Denen et al. | |
| 2002/0150198 | A1 | 10/2002 | Thompson et al. | |
| 2003/0168549 | A1 * | 9/2003 | Formon et al. | 242/563 |
| 2003/0222779 | A1 | 12/2003 | Schotz et al. | |
| 2004/0178297 | A1 | 9/2004 | Moody et al. | |
| 2005/0018375 | A1 | 1/2005 | Takayanagi | |
| 2005/0167541 | A1 | 8/2005 | Osborne | |
| 2007/0176041 | A1 | 8/2007 | Friesen et al. | |
| 2008/0100982 | A1 * | 5/2008 | Lewis et al. | 361/220 |
| 2008/0128448 | A1 * | 6/2008 | Cittadino et al. | 221/11 |
| 2008/0245922 | A1 | 10/2008 | Fellhoelter | |
| 2009/0057478 | A1 | 3/2009 | Conner | |
| 2009/0066199 | A1 * | 3/2009 | de Jong et al. | 312/34.6 |
| 2010/0044493 | A1 * | 2/2010 | Granger | 242/566 |
| 2011/0253829 | A1 | 10/2011 | Goeking et al. | |
| 2012/0019495 | A1 | 1/2012 | Chang et al. | |
| 2012/0312853 | A1 | 12/2012 | Osborne et al. | |
| 2013/0096729 | A1 | 4/2013 | Wegelin | |

FOREIGN PATENT DOCUMENTS

| | | |
|---|---|---|
| EP | 2377442 | 10/2011 |
| JP | 2010233971 | 10/2010 |

* cited by examiner

ELECTRONIC RESIDENTIAL TISSUE DISPENSER

TECHNICAL FIELD

Embodiments of the invention relate generally to tissue dispensing mechanisms and, more particularly, to electronic tissue dispensing systems for perforated flexible sheet material.

BACKGROUND

The dispensing of paper products has resulted in many different types of dispensing devices for controlling quantities dispensed as well as for determining how efficiently the paper products are dispensed. Primarily, these dispensers use mechanical paper feeding mechanisms, actuated by the user physically touching the dispenser equipment to deliver a fixed length of paper. This bodily contact can raise concerns over hygiene when such dispensers are located in public restroom facilities.

Commercial dispensing devices for separating a continuous roll of tissue paper typically include a pair of arms for supporting the roll of tissue. Such devices include a driving roller and a pressing roller for pulling the tissue down through the dispenser throat. A cutting blade can cut the toilet paper when the paper is pulled by the user. Dispensing devices for separating a continuous roll of tissue paper with tear lines (i.e., perforations) typically drive the tissue through the dispenser so that the user tears the tissue paper along the tear lines.

The use of electronic dispensers is becoming more prevalent especially in public restroom facilities where the electronic dispensers can dispense a measured length of towel sheet material upon sensing the presence of a user. In such "hands free" operation, the user does not manually activate or otherwise contact the dispenser in order to initiate a dispense cycle. However, the thinness of tissue sheet material has generally prevented the use of electronic dispensers for either public-use or residential dispensing equipment because the dispensing equipment will stop functioning if the perforated tissue breaks inside the dispenser.

In addition, conventional electronic dispensers accumulate and discharge static electricity during the dispense cycle. Static charge can be generated by various components or operations such as the movement of sheet material over rollers, interactions between rollers, etc. If the static charge is not dissipated, the user may receive a static shock if he touches the dispenser during use. The static charge can adversely affect the electronic control and sensor circuitry in the dispenser.

SUMMARY

In one embodiment, an electronic tissue dispenser is provided for dispensing tissue sheet material. A dispenser housing contains a support mechanism for holding at least one roll of tissue sheet material, and includes a base for mounting to a surface, a cover pivotally mounted to the base, and a discharge chute formed within the housing for discharging the tissue sheet material from the dispenser. A control circuit in the housing can control dispensing of the sheet material from the housing. A dispensing mechanism can drive tissue sheet material from the housing upon receiving a signal from the control circuit. The dispenser can include an adjustable proximity sensor. The dispensing mechanism is operative to be responsive to a signal from the proximity sensor to dispense a sheet of material.

In one embodiment, an automatic electronic dispenser for dispensing a roll of paper product includes a dispenser module for driving paper from the roll through a discharge chute at the bottom of the module. A front cover hinged on each side rotates to an open position for loading a paper roll. A back cover enables mounting the electronic dispenser to a vertical surface such as a wall. The dispenser module includes a paper roll holder attached to the sides of the dispenser module; a driving roller for unrolling the paper from the paper holder in response to a signal from an electronic sensor; and a plurality of pressing rollers, the pressing rollers engaging the driving roller as paper is being dispensed along a path between the pressing and driving rollers to a discharge chute.

In another embodiment, an automatic electronic dispenser for dispensing a roll of perforated tissue paper includes a dispenser module for driving perforated tissue from the roll through a discharge chute at the bottom of the module. The dispenser module has a front portion that is pivotable about a hinge. The dispenser module includes a paper roll holder attached to the sides of the dispenser module; a driving roller for unrolling the perforated tissue from the paper holder in response to a signal from an electronic sensor; and a plurality of pressing rollers, the pressing rollers engaging the driving roller as perforated tissue is being dispensed along a path between the pressing and driving rollers to a discharge chute. A front cover hinged on each side rotates to an open position for loading a roll of perforated tissue paper causing the front portion of the dispenser module to pivot forward.

BRIEF DESCRIPTION OF THE DRAWINGS

These and other advantages and aspects of the embodiments of the disclosure will become apparent and more readily appreciated from the following detailed description of the embodiments taken in conjunction with the accompanying drawings as follows.

DETAILED DESCRIPTION

Figure 1:
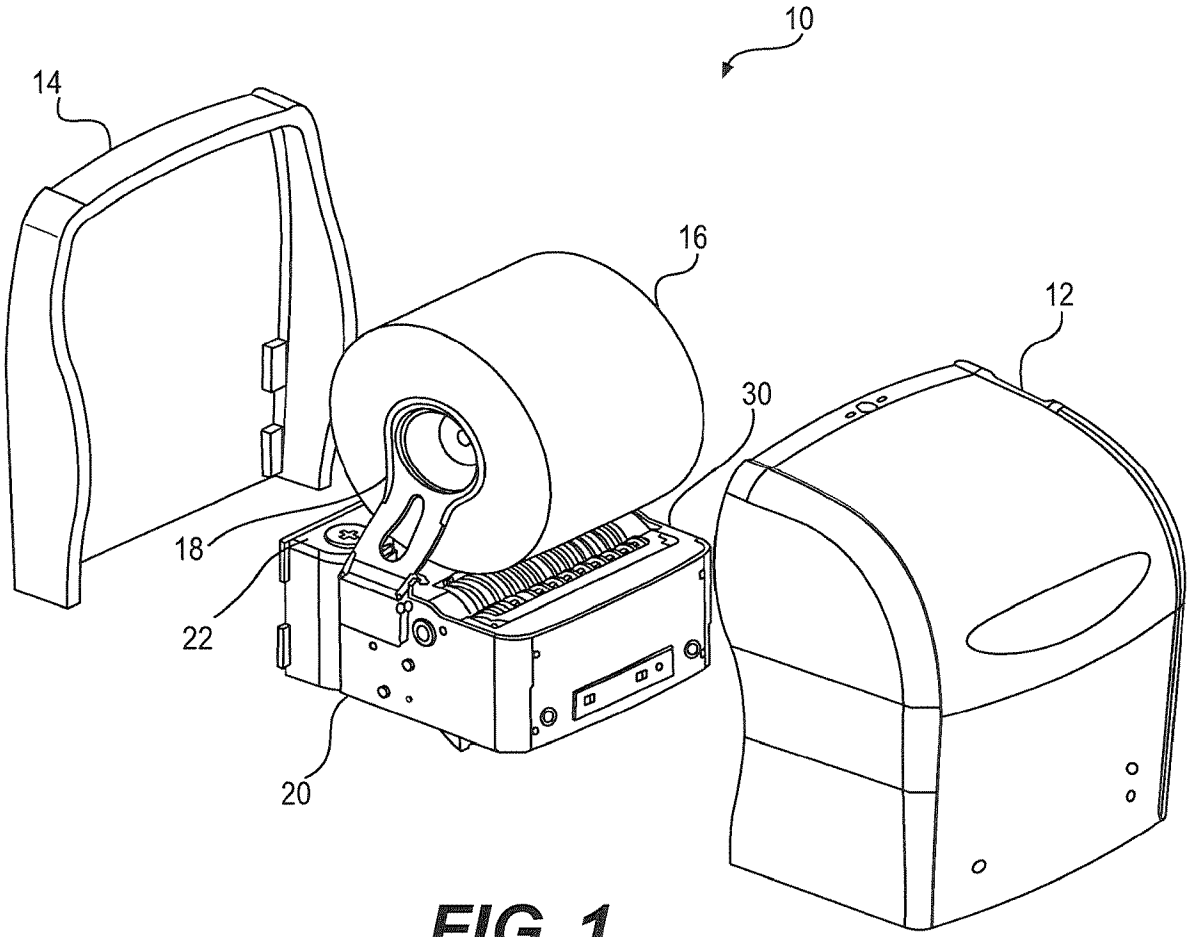
FIG. 1 illustrates an isometric view of components of the electronic residential dispenser with front and back covers removed in an exemplary embodiment.

The following description is provided as an enabling teaching of embodiments of the invention. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable in certain circumstances. Thus, the following description is provided as illustrative of the principles of the invention and not in limitation thereof, since the scope of the invention is defined by the claims.

The embodiments described may utilize concepts disclosed in commonly-owned patents U.S. Pat. No. 7,213,782 entitled "Intelligent Dispensing System" and U.S. Pat. No. 7,370,824 entitled "Intelligent Electronic Paper Dispenser," both of which are incorporated by reference herein. The embodiments may also utilize concepts disclosed in published patent application US 2008/0100982 entitled "System and Method for Dissipating Static Electricity in an Electronic Sheet Material Dispenser" and incorporated by reference herein.

The dispenser in the disclosed embodiments may also be referred to herein as the electronic residential tissue dispenser (ERTD) although the disclosed embodiments of the dispenser are also suitable for public or commercial uses.

In one embodiment, a tissue dispenser is provided wherein the tissue paper can actually sit on the dispenser arms in a manner similar to that of towel dispensers currently available. When the user pulls tissue paper from the roll (manual operation), the tissue paper is pulled by the large driving roller through the two small pressing rollers. The problem with tissue paper is that is perforated. With the current design of towel dispensers modified for use as a tissue dispenser, if the user pulls tissue and the perforation breaks above the pressing roller, the paper can no longer feed. The paper will not feed unless the dispenser unit "rolls the roll" as disclosed in U.S. Pat. No. 7,213,782 and U.S. Pat. No. 7,370,824. However, a more cost-effective design for tissue dispensing is provided by the disclosed embodiments having at least double pressing rollers. If the perforation tears between the two pressing rollers the dispenser will continue to self-feed in both manual and automatic operation (using infrared sensors to trigger tissue dispensing).

The embodiments disclosed are suitable for both residential and commercial use. The use of double pressing rollers is unique in dispenser mechanisms. Other tissue dispensers function like the commercially available paper towel dispensers. If a perforation is read when paper is being dispensed, the dispenser re-feeds the perforated sheet and then sets the tissue so that it tears on the other side of the pressing roller.

In the exemplary embodiments, perforations are not read since it does not matter where the perforation is because of the double pressing rollers. Unless the tissue breaks above the top pressing roller, the tissue in the dispenser is always self-feeding. The tissue paper is always re-fed automatically through the driving roller and the dual pressing rollers.

FIG. 1 illustrates an isometric view of components of the electronic residential dispenser with front and back covers removed in an exemplary embodiment. In this embodiment, the electronic residential dispenser 10 includes an electronic residential dispenser module 20, a rear cover 14 that can be mounted to a wall, a front cover 12, a roll of perforated tissue paper mounted between a pair of paper holder arms 18, battery compartment lid 22, and roller assembly 30. The roller assembly including the driving roller and dual pressing rollers is described in detail herein. Although this embodiment is intended for mounting to a wall in a residential bathroom, other embodiments may use other types of mounts including a pedestal mount. This embodiment can also be installed in a commercial restroom modified to accept alternating current power instead of battery power.

Figure 2:
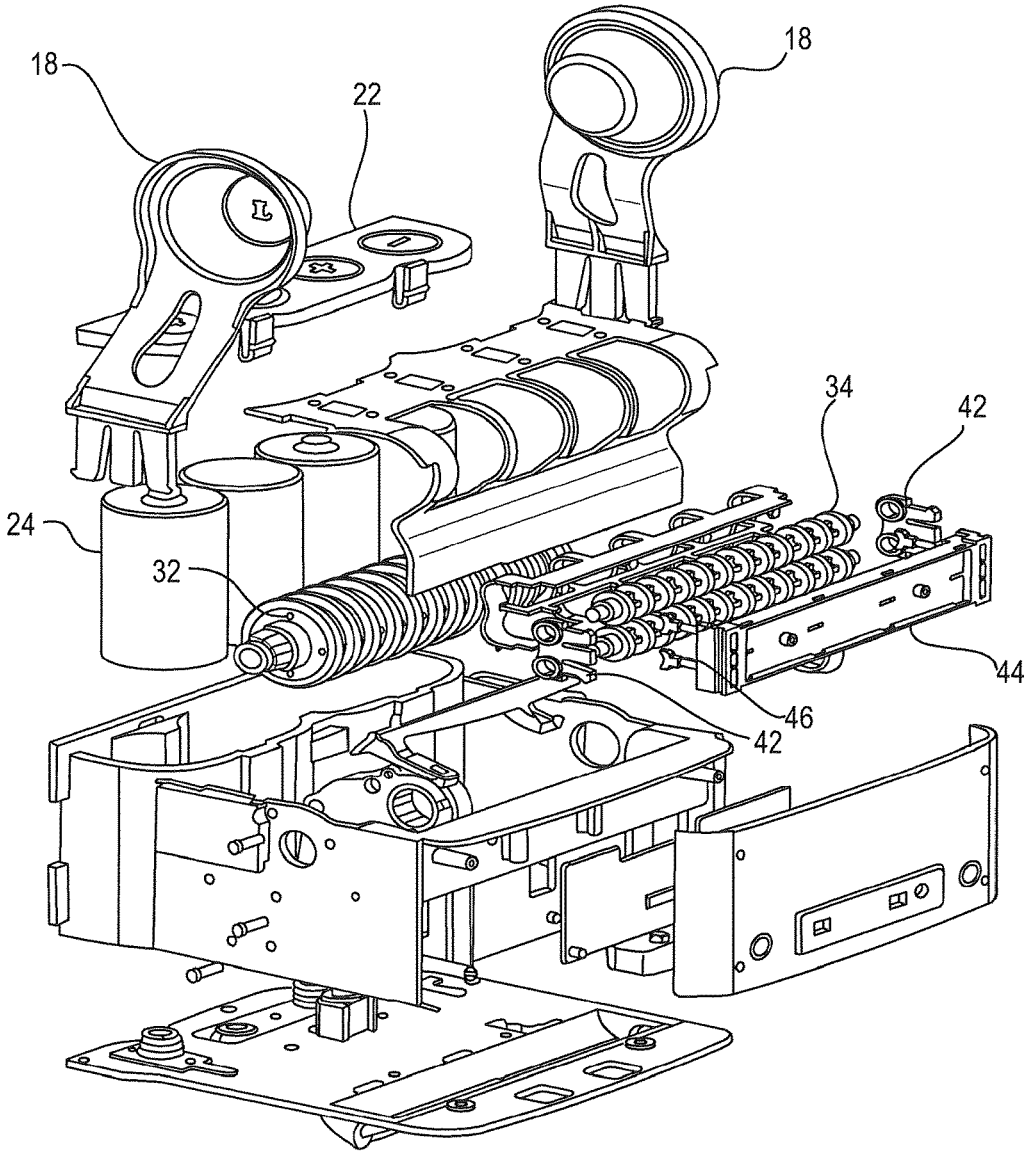
FIG. 2 illustrates an exploded isometric view of the components of the electronic residential dispenser in an exemplary embodiment.

FIG. 2 illustrates an exploded isometric view of the components of the electronic residential dispenser in an exemplary embodiment. The components shown include driving roller 32, dual pressing rollers 34, paper holder arms 18, battery lid 22, batteries 24, and various frame components. The dual pressing rollers 34 are mounted between end mounts 42 and to frame 44 by front mounts 46. The dual pressing rollers 34, driving roller 32, and most components of electronic residential dispenser 10 are made from ABS plastic, although other materials may be used in other embodiments.

In the prior art, paper dispensers use a single pressing roller. However, with a single pressing roller, the user can tear the paper and the perforation may break inside the rollers. In the exemplary embodiment of FIG. 2, the two pressing rollers 34 are spring-loaded ABS rollers. The two pressing rollers 34 press against the driving roller 32. The two pressing rollers are also referred to herein as double or dual pressing rollers. Both pressing rollers 34 press against the driving roller 32 when tissue is being dispensed. This allows the dispenser mechanism to prevent tissue perforations from tearing above the second pressing roller. If the perforation ever breaks between the pressing rollers, the tissue paper will continue to feed.

In an exemplary embodiment, the electronic tissue paper dispenser has standard arms for holding the roll of tissue paper. The double pressing rollers may also be referred to as double feeding rollers. In contrast to automatic tissue dispensers in the art which include a tear bar or similar mechanism to cut paper towel, the disclosed embodiments do not have or need a tear bar. Instead a flapper bar is located at the bottom of the discharge chute (dispenser throat). The significance of having two rollers pressing on the driving roller is that if the perforations ever break on the upstream side of the second pressing roller, the second pressing roller continues to feed the paper. If the perforation breaks on the discharge side, the paper will continue to feed when requested by the user.

Figure 3:
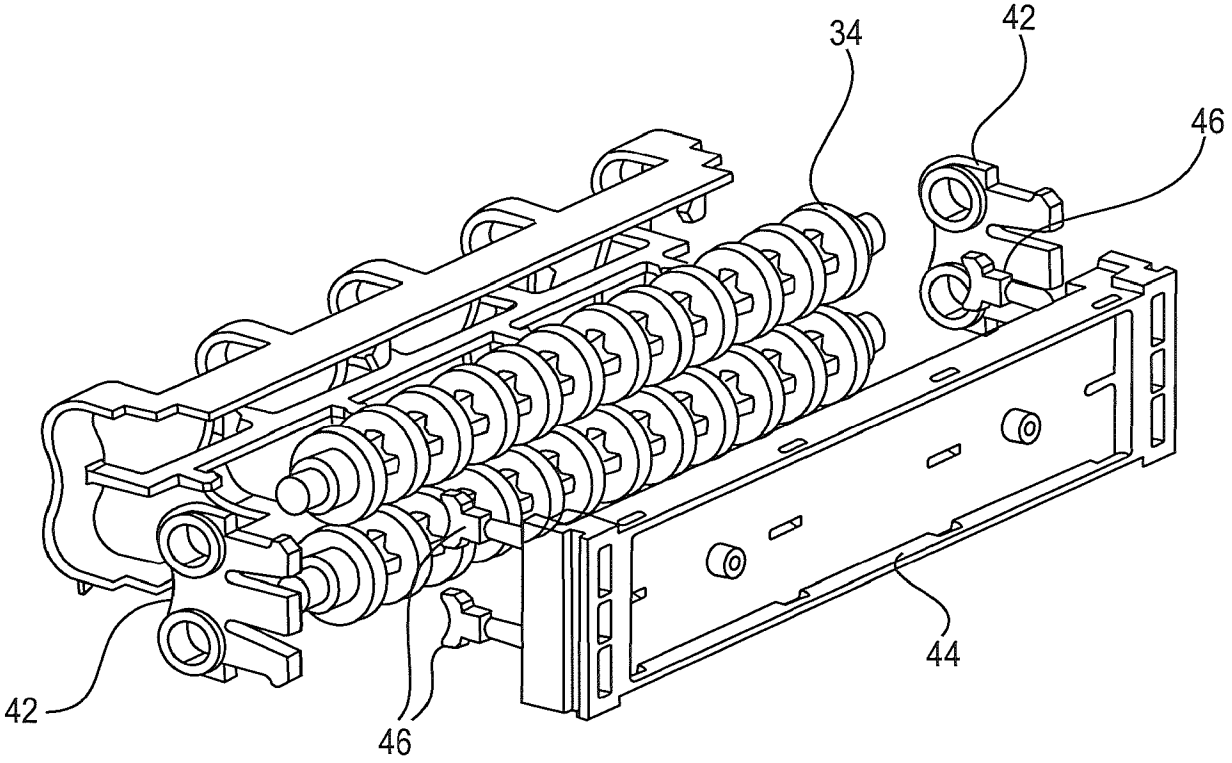
FIG. 3 illustrates an exploded view of the dual driving roller assembly in an exemplary embodiment.

FIG. 3 illustrates an exploded view of the dual driving roller 34 assembly in an exemplary embodiment. The figure shows the dual pressing rollers 34, end mounts 42, front frame part 44, and a plurality of mounts 46 for securing frame part 44 to the dual pressing rollers 34.

Figure 4A:
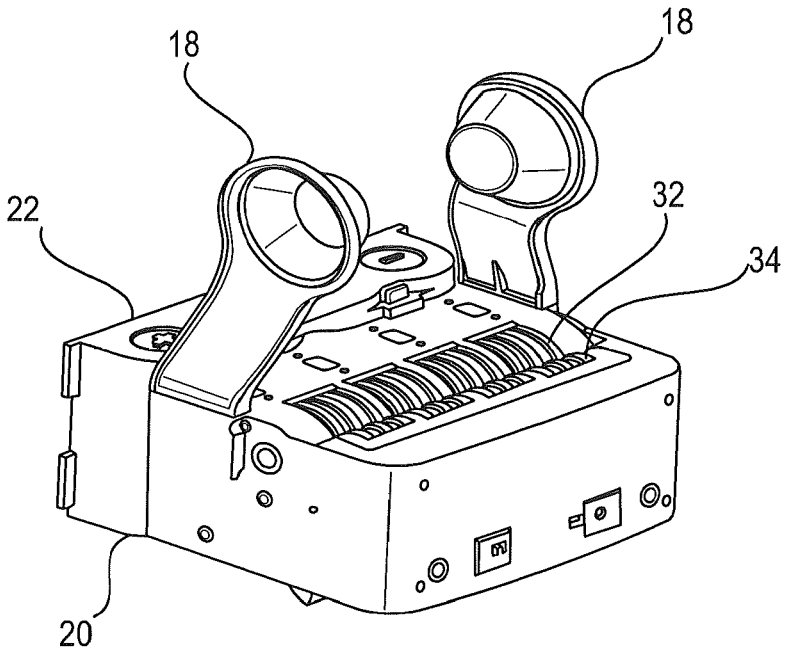
FIGS. 4A-4B illustrate external isometric front and bottom views of the residential electronic dispenser in an exemplary embodiment.
Figure 4B:
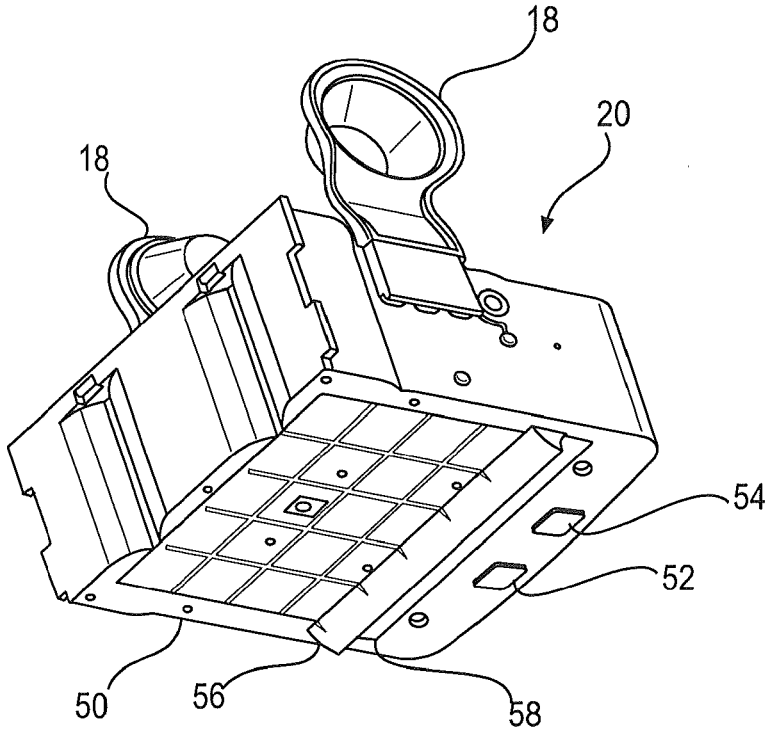

FIGS. 4A-4B illustrate external isometric front and bottom views of the residential electronic dispenser in an exemplary embodiment. The front isometric view of FIG. 4A shows the paper holder arms 18, the battery compartment lid 22, the driving roller 32, and the upper pressing roller 34 of residential electronic dispenser 20. FIG. 4B shows bottom surface 50, cutting bar 56, and proximity sensors 52, 54 which detect the presence of a user's hand below the throat 58 of the dispenser 20. In one embodiment, the proximity sensors may include an infrared emitter and an infrared receiver. A flapper bar 56 is located adjacent the discharge chute (throat) 58 of the dispenser 20 for removing the perforated tissue paper hanging below the discharge chute 58.

Figure 5B:
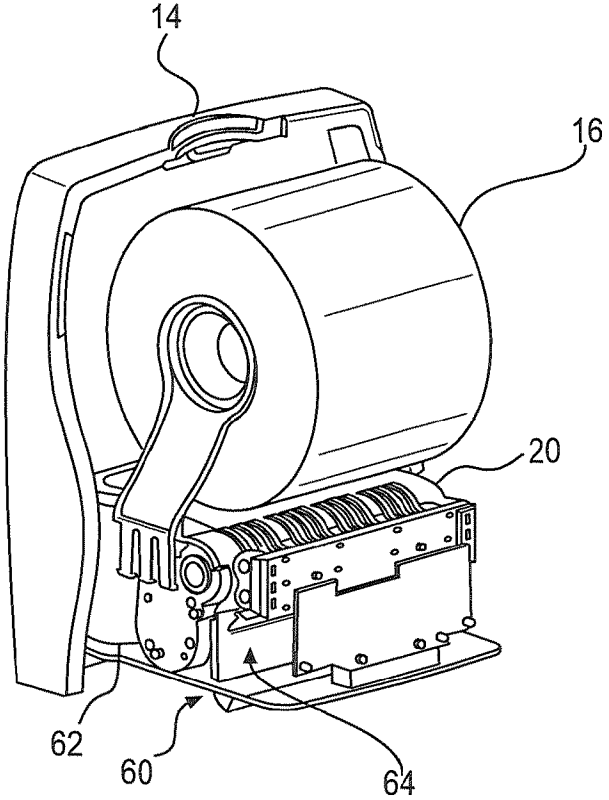
FIGS. 5A-5B illustrate the electronic residential dispenser module supporting a roll of electronic tissue between a pair of paper holder arms showing the location of a static release inside in an exemplary embodiment.
Figure 5A:
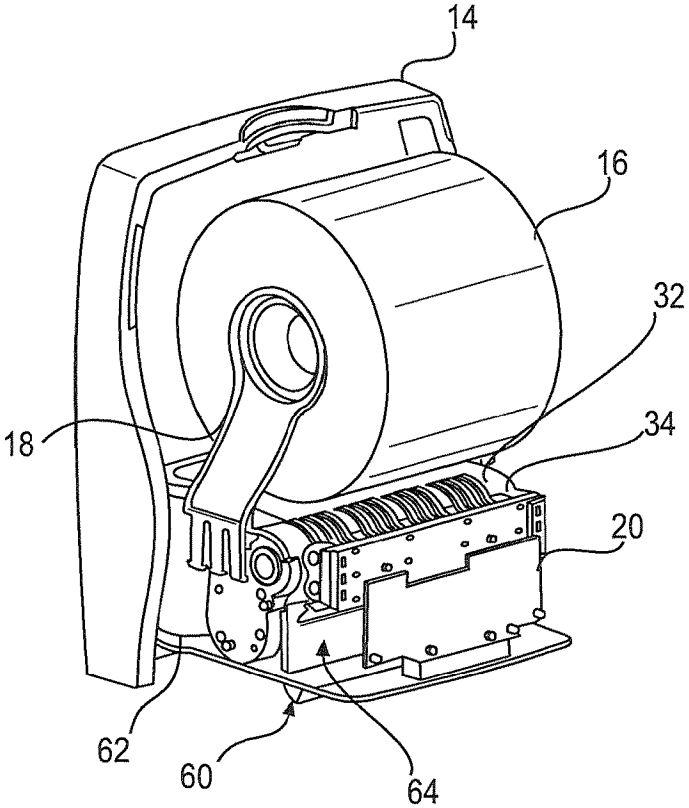

FIGS. 5A-5B illustrate the electronic residential dispenser module supporting a roll of tissue paper between a pair of paper holder arms showing the location of a static release in an exemplary embodiment. FIG. 5A shows the roll of tissue paper 16 which may be perforated held in place by paper roll holder 18. Also shown is driving roller 32 contacting pressing roller 34. FIG. 5B shows an interior portion of the electronic residential dispenser module 20 including a static release 60. Static is released from the bottom of the module 20. The dual rollers solve the paper break problem inside the dispenser module. The batteries that provide power for operation of the dispenser are loaded in the battery compartment on the back part of the dispenser. The static release is from the bottom of the dispenser module.

Figure 6B:
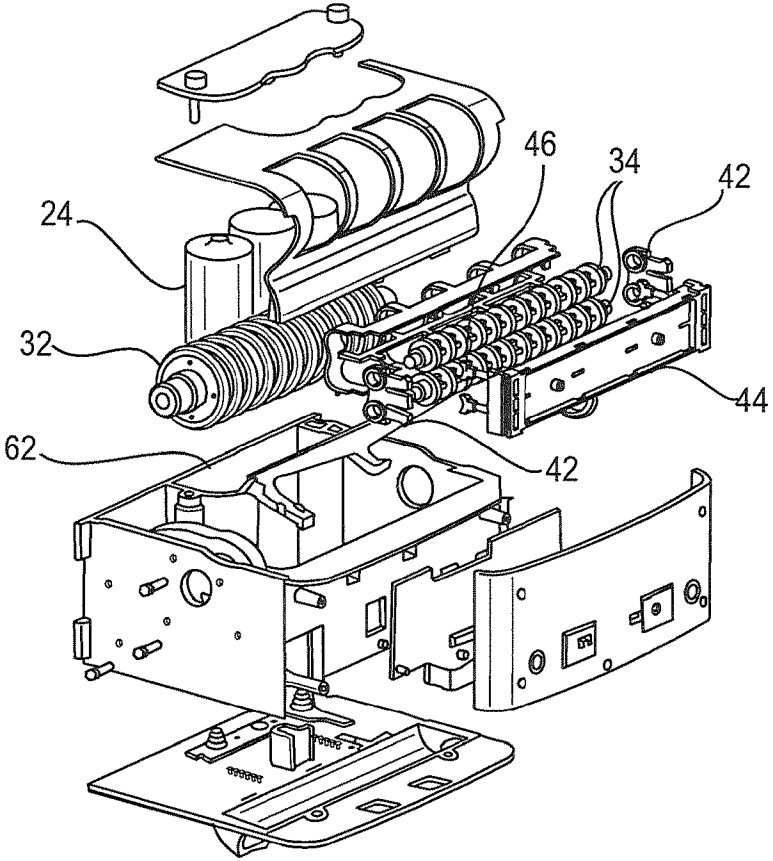
FIGS. 6A-6B illustrate the electronic residential dispenser module with the paper holder arms removed and an exploded view of the module frame and other components in an exemplary embodiment.
Figure 6A:
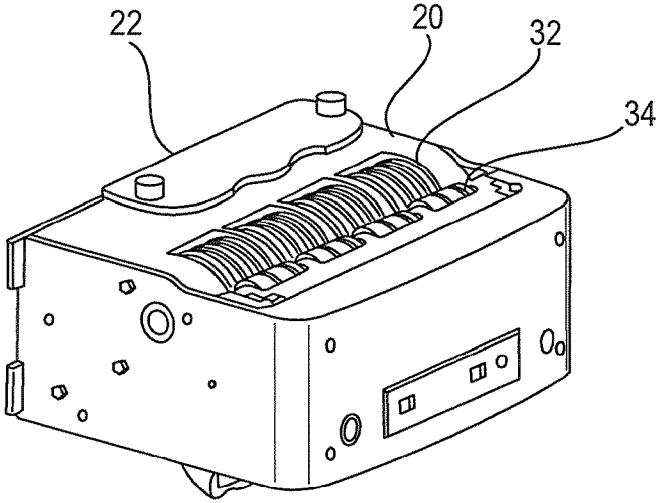

FIGS. 6A-6B illustrate the electronic residential dispenser module with the paper holder arms removed and an exploded view of the module frame and other components in an exemplary embodiment. FIG. 6A shows the position of battery compartment lid 22 covering the battery compartment of residential dispenser module 20 and the top parts of the driving roller 32 and the upper pressing roller of dual pressing roller 34. The exploded view of the module frame in FIG. 6B also shows battery compartment 62, batteries 24, driving roller 32, dual pressing rollers 34, end mounts 42, front frame part 44, and a plurality of mounts 46 for securing frame part 44 to the dual pressing rollers 34.

Figure 7B:
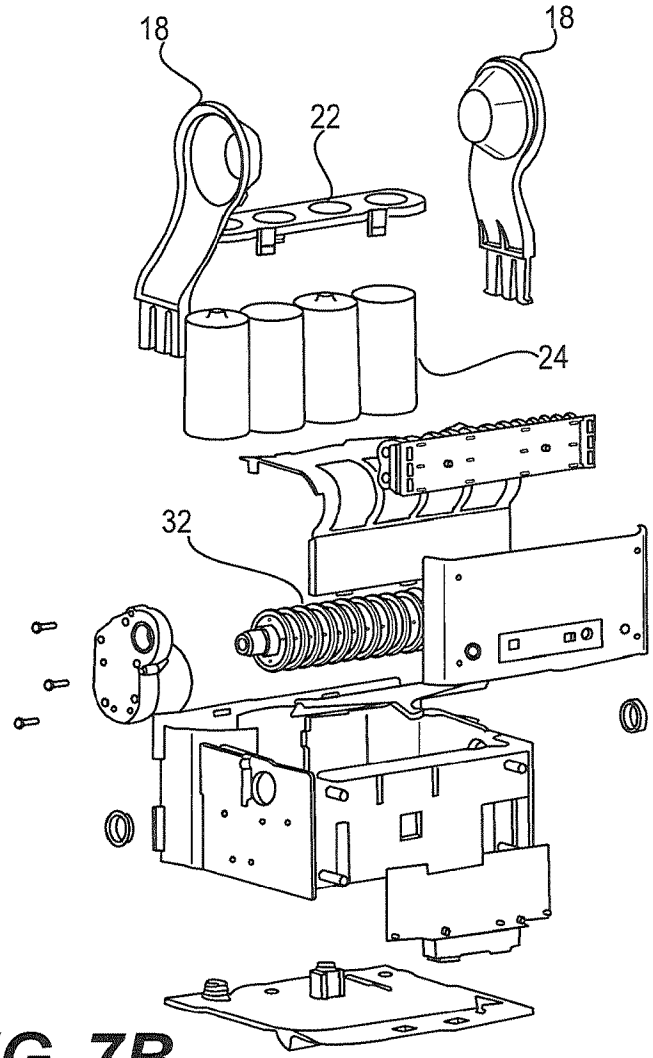
FIGS. 7A-7B illustrate the electronic residential dispenser module with the paper holder arms installed and an exploded view of the module frame and other components in an exemplary embodiment.
Figure 7A:
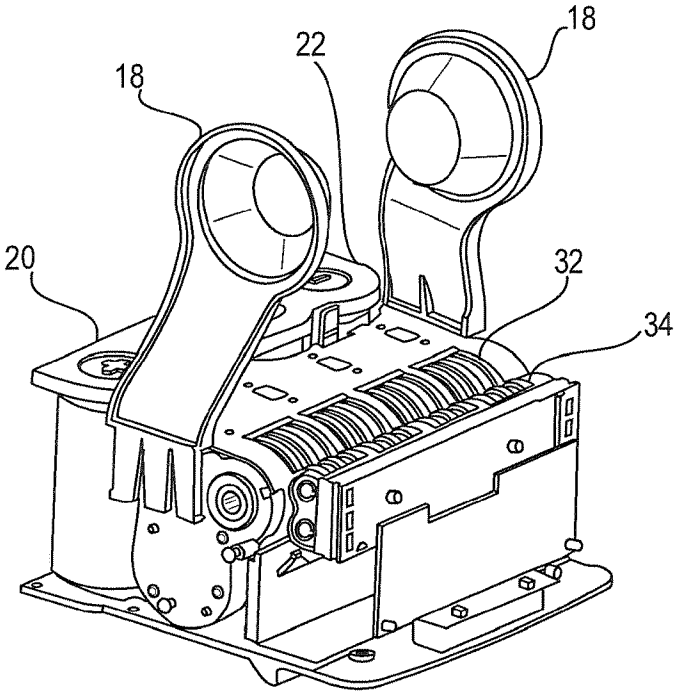

FIGS. 7A-7B illustrate the electronic residential dispenser module with the paper holder arms installed and an exploded view of the module frame and other components in an exemplary embodiment. FIG. 7A shows the attachment of the paper holder arms to the electronic residential dispenser module 20. In one embodiment, the paper holder arms 18 may be similar to paper holder arms used to support heavier sheet material such as paper towels. The driving roller 32, pressing roller 34, and battery compartment lid 22 of electronic residential dispenser module 20 are also shown in this drawing. FIG. 7B shows an exploded view of the module frame in addition to driving roller 32, battery compartment lid 22, batteries 24, and paper holder arms 18.

Figure 8:
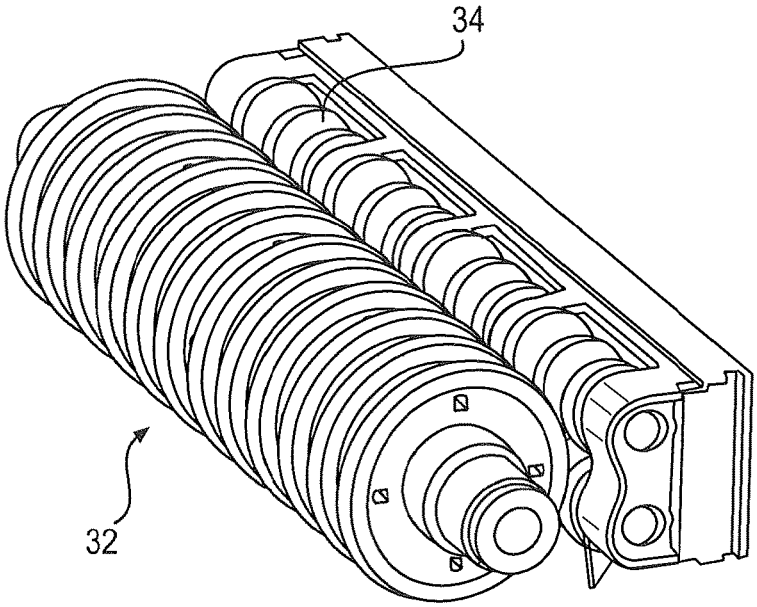
FIG. 8 illustrates the driving roller and dual pressing rollers in physical contact with each other in an exemplary embodiment.
Figure 9:
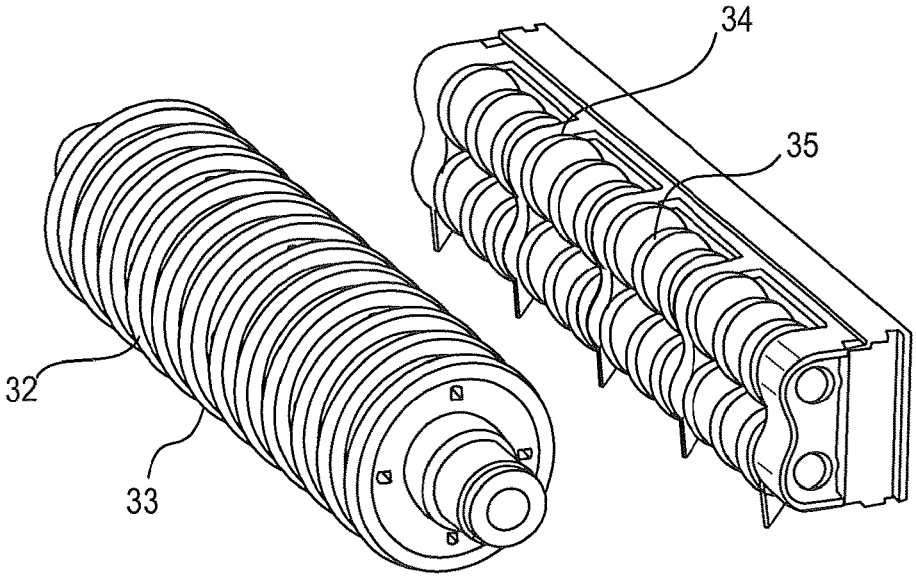
FIG. 9 illustrates the separate driving roller and dual pressing roller components in an exemplary embodiment.

FIGS. 8-9 illustrate the driving roller 32 and dual pressing rollers 34 in physical contact with each other and separately, respectively, in an exemplary embodiment. In the embodiments shown, both driving roller 32 and pressing rollers 34 include a series of evenly-spaced annular ridges 33, 35, respectively, on the periphery of each roller. As the rollers 32, 34 are activated to dispense tissue paper 16 between the rollers, the ridges 33, 35 make contact with the tissue paper 16 as the rollers rotate to drive the tissue paper through the discharge chute. In other embodiments, the driving and dual pressing rollers may be fabricated without ridges (i.e., continuous outer surface) on the periphery of each roller.

Figure 10B:
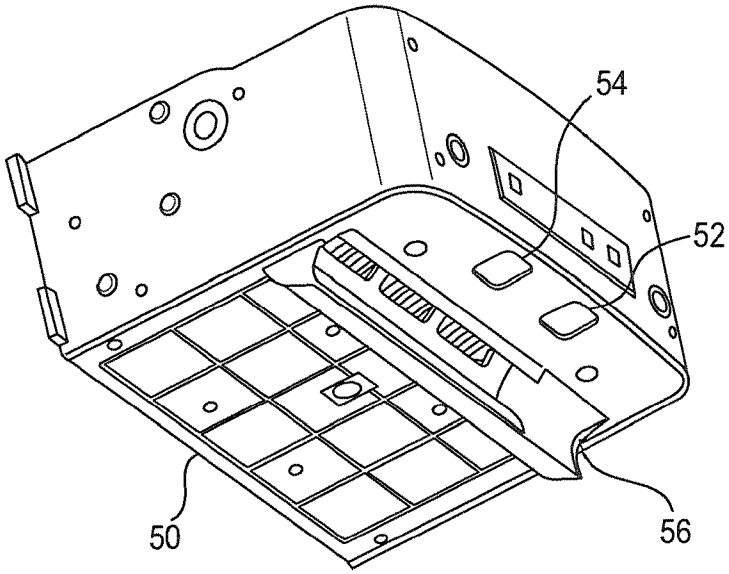
FIGS. 10A-10B illustrate front and bottom isometric views of the electronic residential dispenser module in an exemplary embodiment.
Figure 10A:
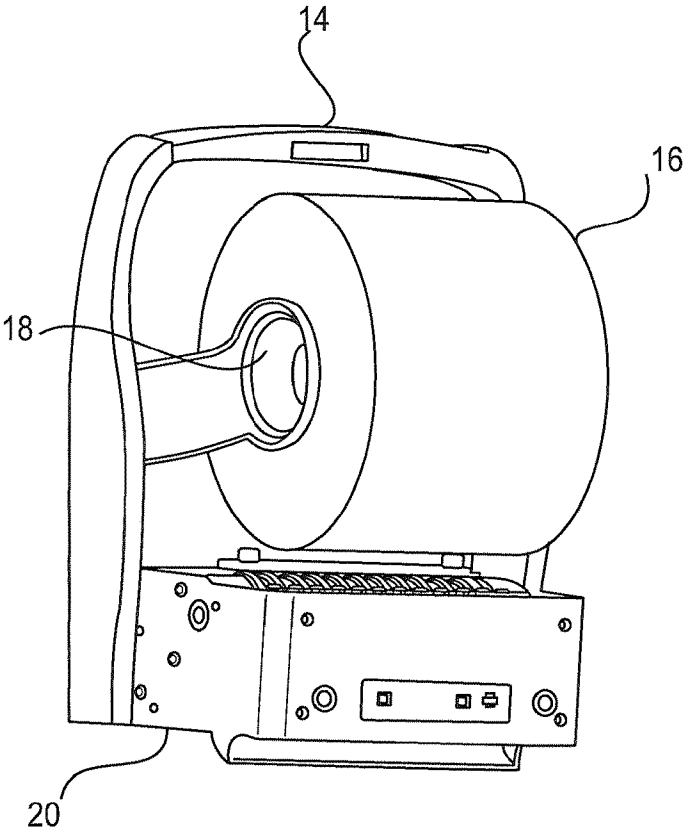

FIGS. 10A-10B illustrate front and bottom isometric views of the electronic residential dispenser module in an exemplary embodiment. FIG. 10A shows the electronic residential dispenser with the front cover removed. The components depicted include dispenser module 20, tissue paper roll 16, paper holder support arm 18, and rear cover 14. FIG. 10B shows bottom surface 50 and proximity sensors 52, 54 which detect the presence of a user's hand below the throat 58 of the dispenser 20. In one embodiment, the proximity sensors may include an infrared emitter and an infrared receiver.

Figure 11:
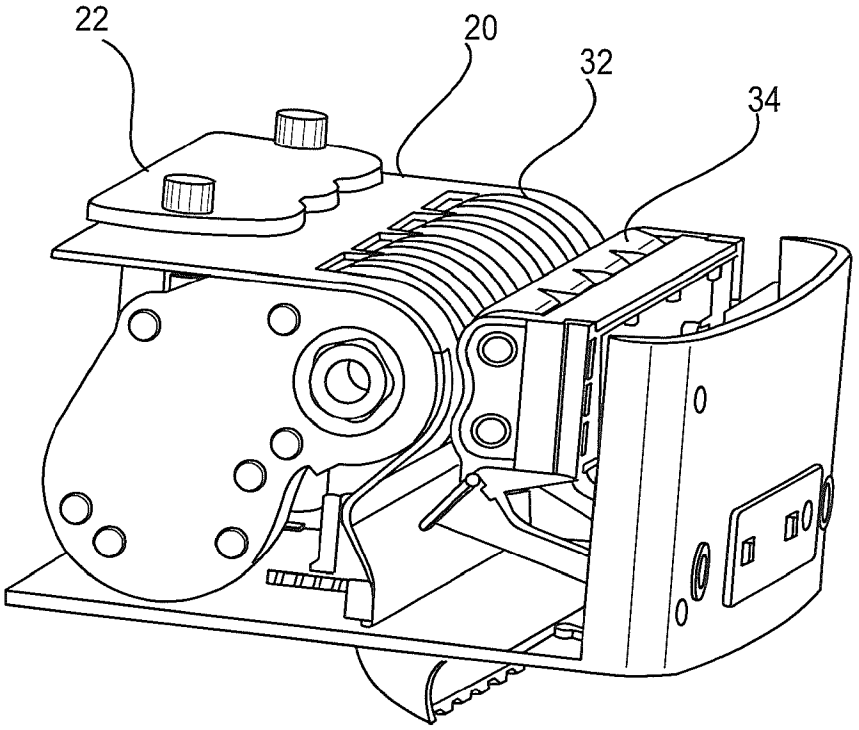
FIG. 11 illustrates an isometric side view of the electronic residential dispenser module with the cover and paper holder arms removed in an exemplary embodiment.

FIG. 11 illustrates an isometric side view of the electronic residential dispenser module with the cover and paper holder arms removed in an exemplary embodiment. FIG. 11 shows driving roller 32, dual pressing rollers 34, and battery compartment cover 22.

Figure 12B:
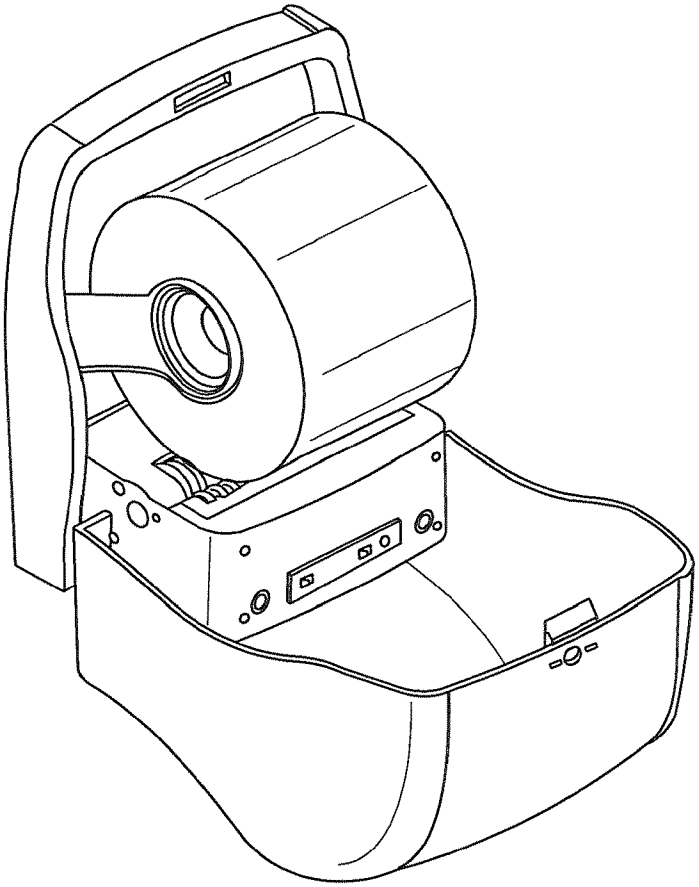
FIGS. 12A-12B illustrate an isometric view of the electronic residential dispenser module with the cover closed and with the cover opened in an exemplary embodiment.
Figure 12A:
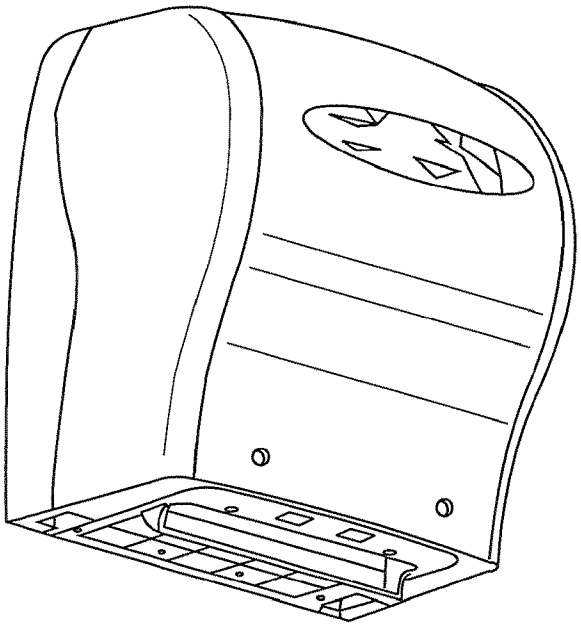

FIGS. 12A-12B illustrate an isometric view of the electronic residential dispenser module with the cover closed and with the cover opened in an exemplary embodiment. As shown in these figures, the electronic residential dispenser module 20 is fixed relative to the frame support.

FIGS. 13-22 illustrate an alternate embodiment of the electronic tissue dispenser in which electronic residential dispenser module 20 has a swivel portion that opens for weight when the front cover is opened.

Figure 13:
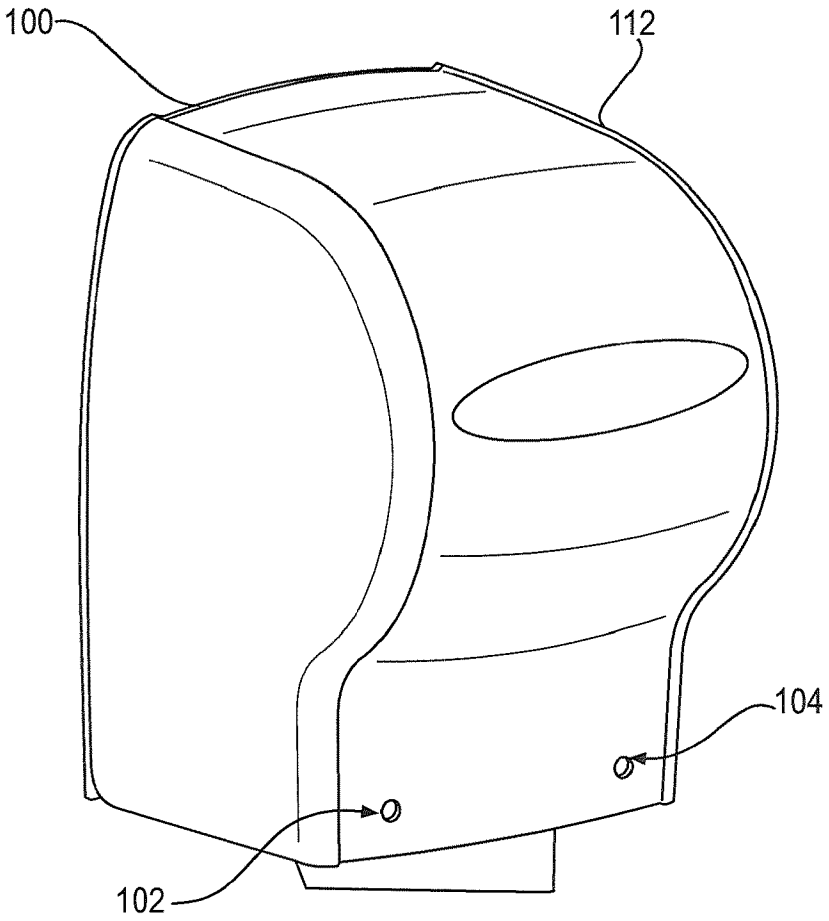
FIG. 13 illustrates an isometric view of an electronic residential dispenser in an alternate exemplary embodiment.

FIG. 13 illustrates an isometric view of an electronic residential dispenser 100 in a closed position in another exemplary embodiment. This embodiment can operate on 3 C-size batteries. Low power light 102 and manual button 104 are on the front cover of the dispenser.

Figure 14:
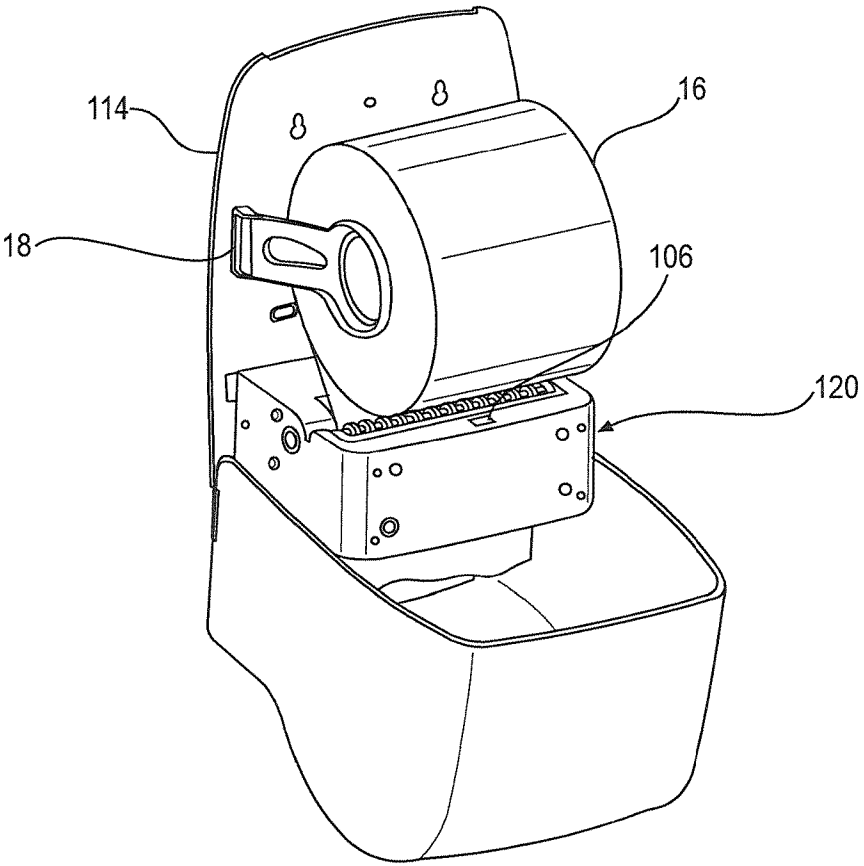
FIG. 14 illustrates an isometric view of an electronic residential dispenser with the front cover open in an alternate embodiment.

FIG. 14 illustrates an isometric view of an electronic residential dispenser with the hinged front cover in an open position. Also shown in this figure is a paper length switch 106, paper roll holder 22, rear wall mounting plate 114, paper roll 16, and electronic tissue dispenser module 120. The electronic tissue dispenser module 120 has a front portion that swivels (i.e., pivots) forward when the hinged dispenser cover is opened. The pivoting forward of the front portion of the electronic tissue dispenser module 120 reduces the requirement for having tight tolerances between the driving roller and the plurality of pressing rollers.

Figure 15:
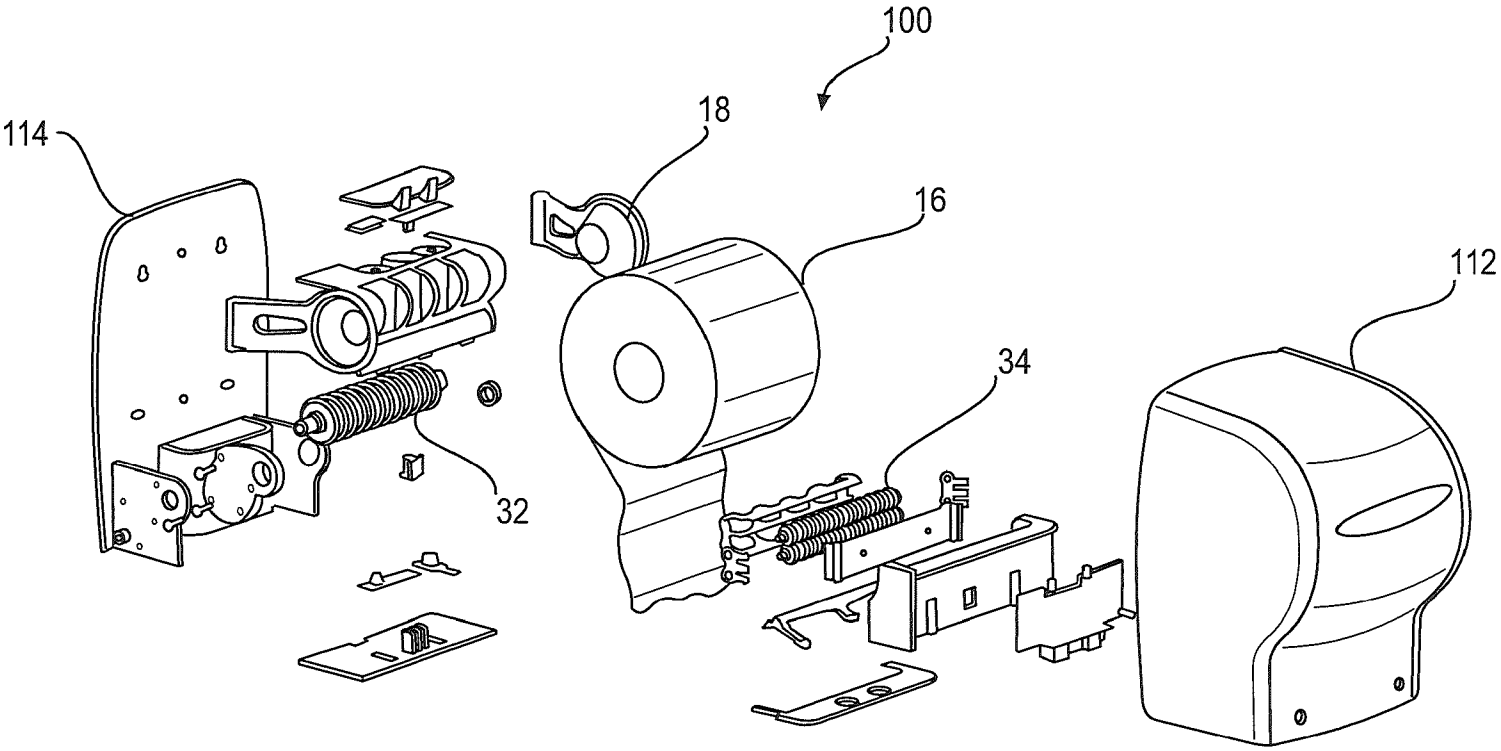
FIG. 15 illustrates an exploded view of the dual driving roller assembly in an alternate embodiment.

FIG. 15 illustrates an exploded view of the dual driving roller assembly in an alternate embodiment. The figure shows the dual pressing rollers 34, the driving roller 32, front cover 112, rear wall mounting plate 114, paper holders 22, and parts of the dispenser frame.

Figure 16:
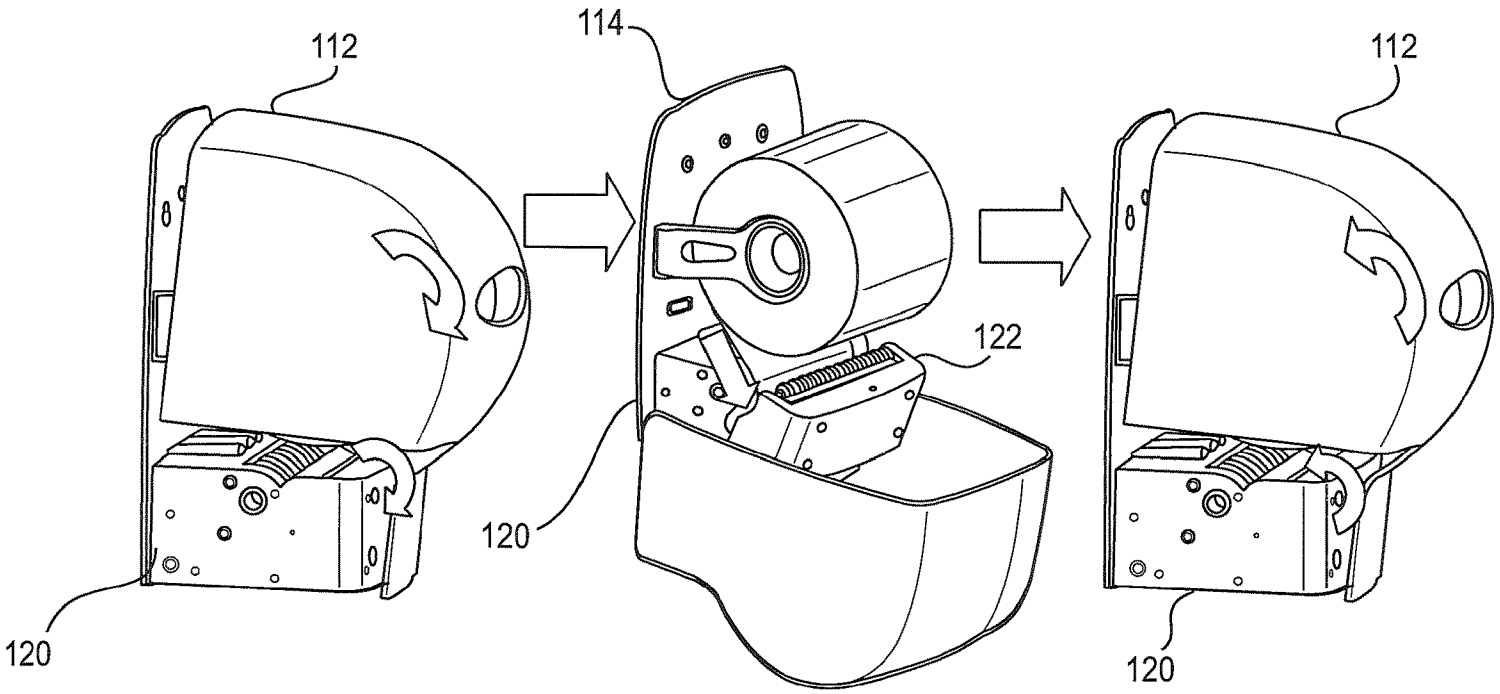
FIG. 16 illustrates a sequence of positions for the components of the electronic residential dispenser as the cover is opened and closed in an alternate embodiment.

FIG. 16 illustrates a sequence of positions for the components of the electronic residential dispenser as the cover is opened and closed in an alternate embodiment. When front cover 112 opens, the swivel part 122 of electronic tissue dispenser module 120 opens and pivots forward. When the cover 112 is closed, the swivel part 122 of electronic tissue dispenser module 120 is pushed close.

Figure 17B:
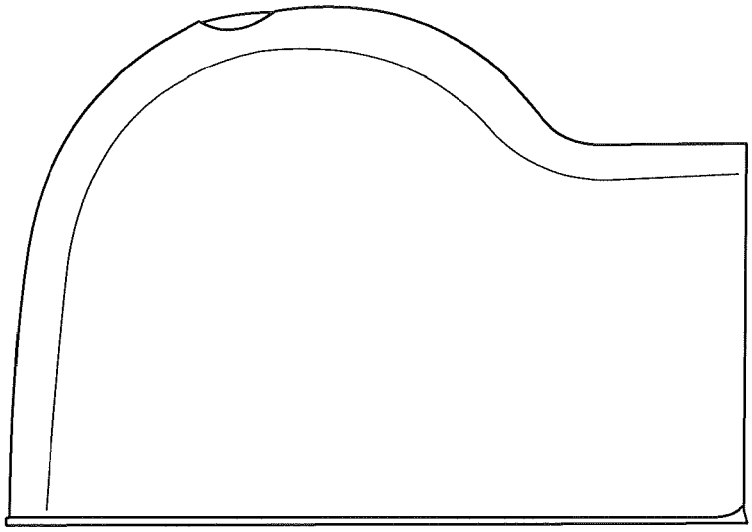
FIGS. 17A-17B illustrate front and side elevation views of the electronic residential dispenser in an alternate exemplary embodiment.
Figure 17A:
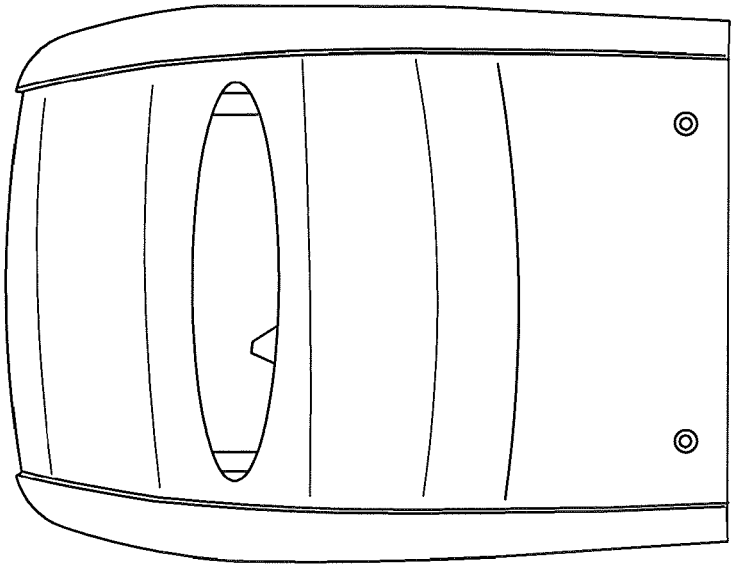
Figure 18B:
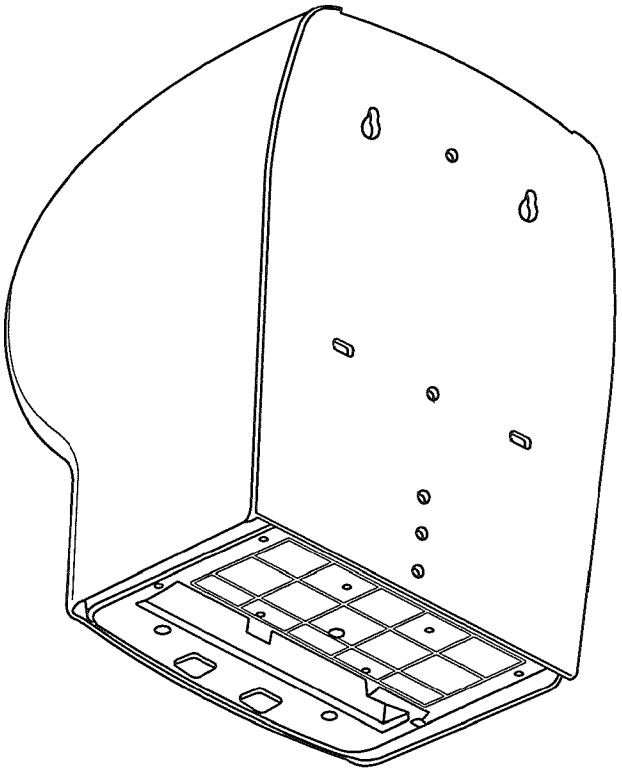
FIGS. 18A-18B illustrate isometric front and rear views of the electronic residential dispenser in an alternate exemplary embodiment.
Figure 18A:
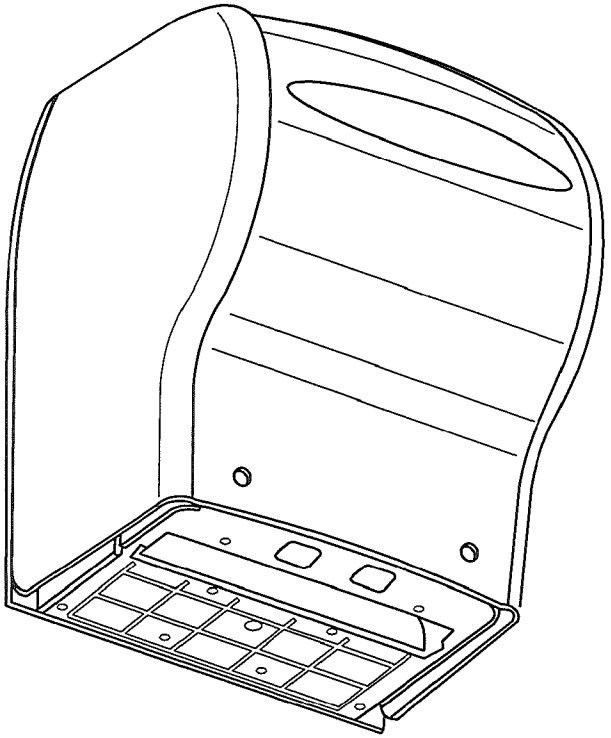

FIGS. 17A-17B illustrate front and side elevation views of the electronic residential dispenser in an alternate exemplary embodiment. FIGS. 18A-18B illustrate isometric front and rear views of the electronic residential dispenser in an alternate exemplary embodiment.

Figure 19:
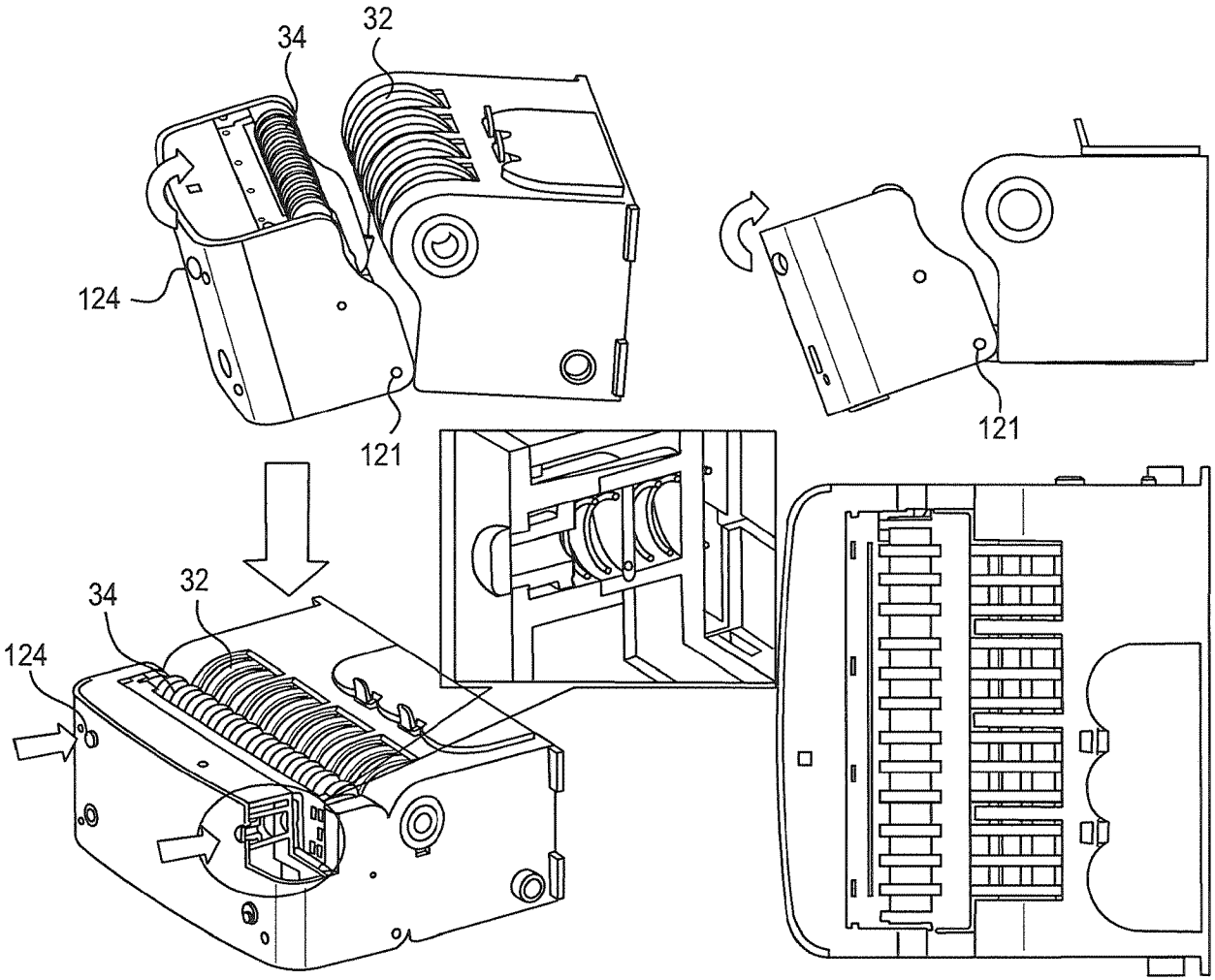
FIG. 19 illustrates a sequence of positions for the components of the electronic residential dispenser module in an alternate exemplary embodiment.

FIG. 19 illustrates a sequence of positions for the components of the electronic residential dispenser module 120 in an alternate exemplary embodiment, including a swivel or forward pivoting portion 122. Opening the front cover results in the swivel portion of electronic tissue dispenser module 120 pivoting about a hinge 121 on the module. When the front cover closes it pushes a pair of buttons 124 on the front side of the swivel portion 122 causing the swivel portion 122 of electronic tissue dispenser module 120 to close.

Figure 20:
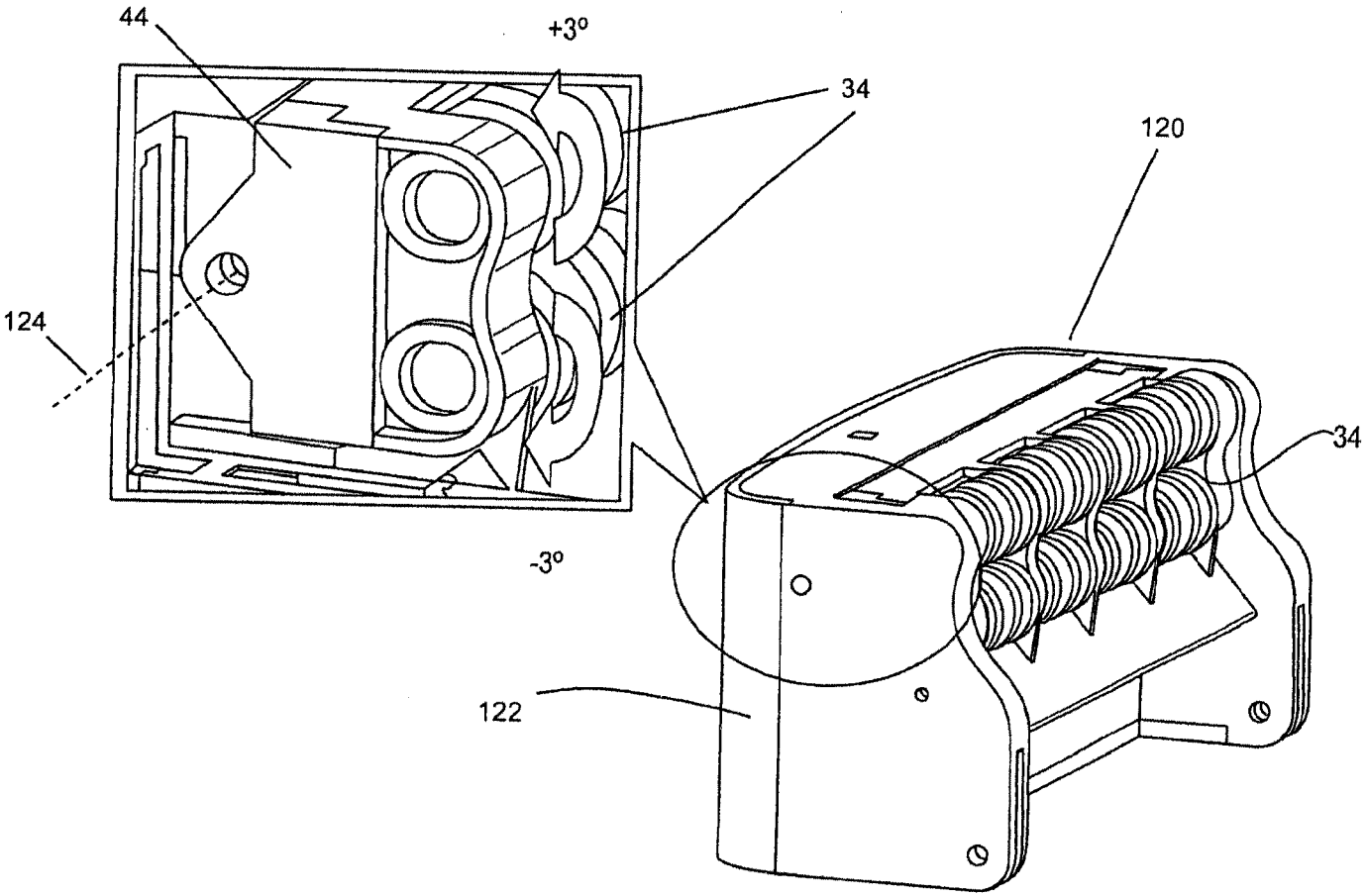
FIG. 20 illustrates the position of the dual pressing rollers inside the electronic residential dispenser with the side cover removed in an alternate exemplary embodiment.
Figure 21:
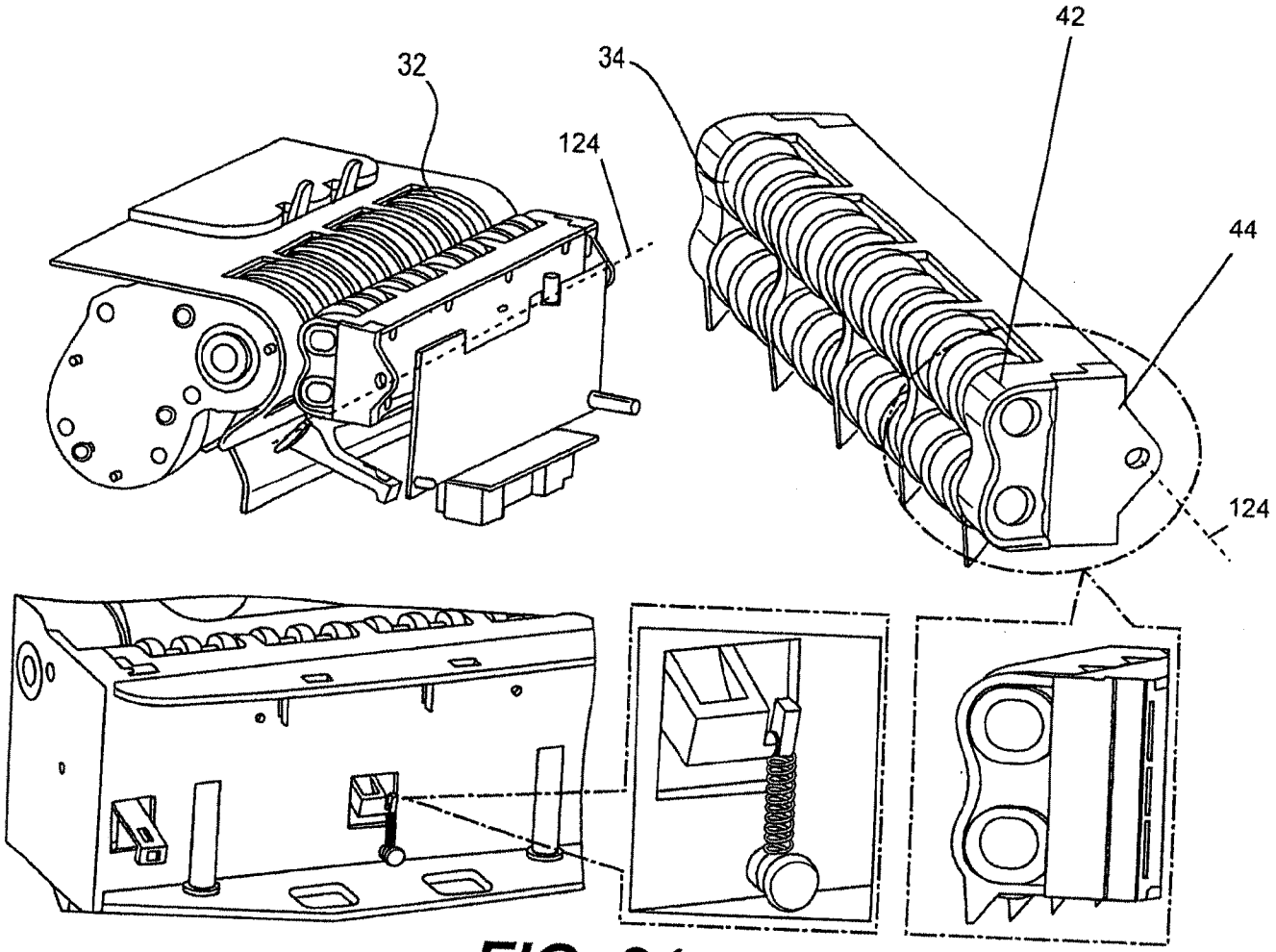
FIG. 21 illustrates the position of the dual pressing rollers inside the electronic residential dispenser with the back and side covers removed in an alternate exemplary embodiment.
Figure 22:
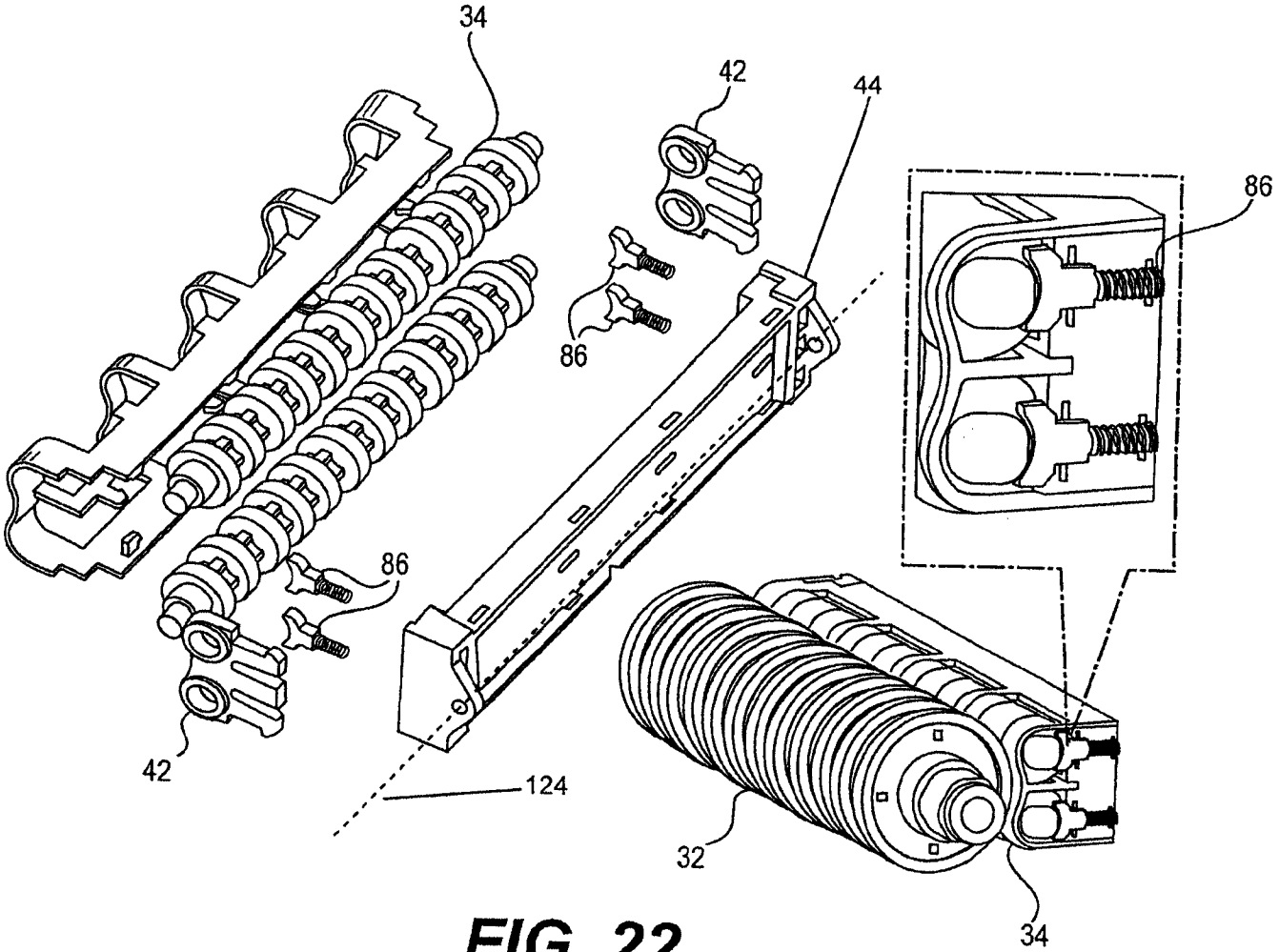
FIG. 22 illustrates an exploded view of the individual components of the dual pressing rollers, driving roller, and spring mounts in an alternate exemplary embodiment.

FIG. 20 illustrates the position of the dual pressing rollers inside the electronic residential module dispenser 120 with the side cover removed. FIG. 21 illustrates the position of the dual pressing rollers 34 inside the electronic residential dispenser with the back and side covers removed. FIG. 22 illustrates an exploded view of the individual components of the dual rollers 34, driving roller 32, and spring mounts 86 for the pressing rollers 34, which spring mounts 86 are mounted to front frame part 44, adjacent end mounts 42 of the frame for the dual pressing rollers. As illustrated in FIGS. 20-22, the dual pressing rollers 34 are pivotable about a common pivot axis 124 (FIG. 21) extending through pins (not shown) connecting the front frame part 44 and the dual pressing rollers 34 to the swivel portion 122 (FIG. 20) of the electronic residential dispenser module 120. Such a pivoting dual roller configuration allows continuous contact with the paper in two positions to eliminate perforation tear resulting in dispenser malfunction. If the perforation tears above the top dual roller 34, the dispenser is not functional. The ability of the pressing rolls to pivot together about axis 124 and the springs 86 enhance the dispensing function, reducing the requirement for tight tolerances between the dual rollers 34 and the main roller 32.

Figure 23:
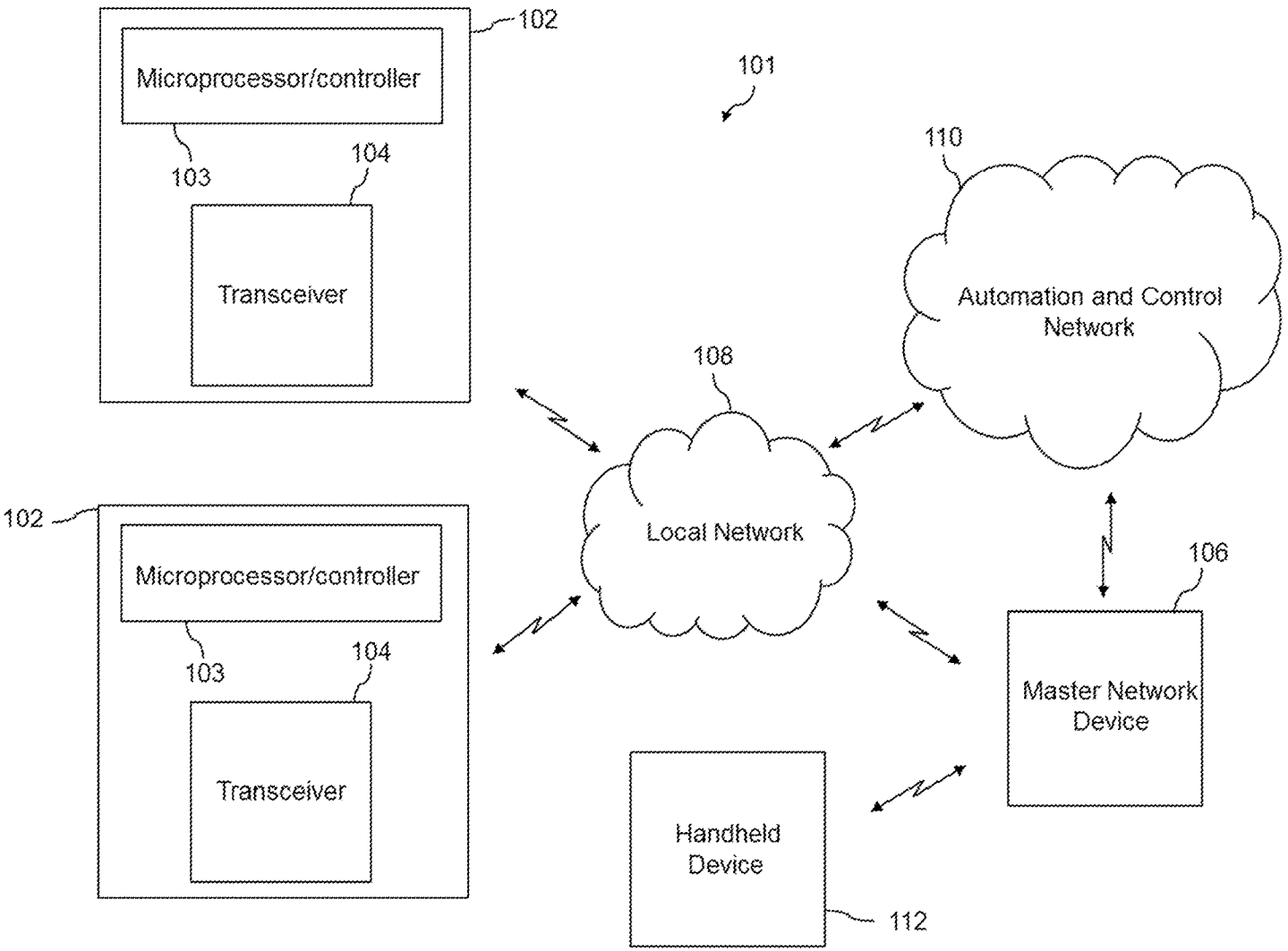
FIG. 23 illustrates a block diagram of an intelligent dispensing system in an exemplary embodiment.

FIG. 23 shows an intelligent dispensing system 101 with dispensers 102 that each include a microprocessor controller 103 and a transceiver 104. As further shown in FIG. 23, a master network device 106 can be operatively connected with the transceiver 104 of each dispenser 102. The dispensers 102 and the master network device 106 can communicate with each other using wireless signals, or a wired connection for communication. A local network 108 can be provided to enable a paper product status message to be transmitted from each dispenser 102 to the master network device 106, such as using a standard data communications protocol. In addition, an automation and control network 110 can be interoperable with the local network 108 for monitoring a status the dispensers 102 (FIG. 23). The automation and control network 110 may use a building automation and control network protocol. The master network device 106 can receive status messages from the transceivers 104 of each dispenser 102, and can transmit status messages over the automation and control network 110. The microprocessor controller 103 for each dispenser 102 also can determine an amount of paper remaining on the paper roll holder and transmit a status message signal containing a status of the paper product to the master network device 106. Handheld devices 112 further can be used for data communications with the master network device 106, as generally shown in FIG. 23.

In an electronic dispenser, a sensor may be provided to detect an object placed in a detection zone external to the dispenser. This sensor may be a passive sensor that detects changes in ambient conditions, such as ambient light, capacitance changes caused by an object in a detection zone, and so forth. In an alternate embodiment, the sensor may be an active device and include an active transmitter and associated receiver, such as one or more infrared (IR) transmitters and an IR receiver. The transmitter transmits an active signal in a transmission cone corresponding to the detection zone, and the receiver detects a threshold amount of the active signal reflected from an object placed into the detection zone. Control circuitry (not shown) is configured with the sensor for initiating a dispense cycle upon a valid detection signal from the receiver.

The dispenser control circuitry controls activation of the dispensing mechanism upon valid detection of a user's hand for dispensing a measured length of the sheet material. Sensors and associated circuitry may be provided for this purpose. Various types of sensors are well known to those skilled in the art, including IR, radio frequency (RF), capacitive sensors, etc. Any one or a combination of such sensing systems can be used.

The corresponding structures, materials, acts, and equivalents of all means plus function elements in any claims below are intended to include any structure, material, or acts for performing the function in combination with other claim elements as specifically claimed.

Those skilled in the art will appreciate that many modifications to the exemplary embodiments are possible without departing from the scope of the present invention. In addition, it is possible to use some of the features of the embodiments disclosed without the corresponding use of the other features. Accordingly, the foregoing description of the exemplary embodiments is provided for the purpose of illustrating the principles of the invention, and not in limitation thereof, since the scope of the invention is defined solely by the appended claims.

What is claimed:

1. An automatic electronic dispenser for dispensing a roll of paper product, comprising:

a dispenser module for driving paper from the roll through a discharge chute at the bottom of the module, the dispenser module including:

a paper roll holder attached to the sides of the dispenser module;

a driving roller for unrolling the paper from the paper roll holder in response to a signal from an electronic sensor; and a frame at least partially supporting a plurality of independent rotatable pressing rollers, the frame connected to one or more biasing members that urge each of the plurality of pressing rollers toward engagement with the driving roller to engage the paper therebetween for dispensing the paper along a path between the pressing and driving rollers to a discharge chute, wherein the pressing rollers are mounted to the frame along a common pivot axis so that one of the pressing rollers is moved toward closer engagement with the driving roller as another one of the pressing rollers is moved away from the driving roller.

2. The automatic electronic dispenser of claim 1 wherein the pressing rollers comprise spring-loaded plastic rollers.

3. The automatic electronic dispenser of claim 1 wherein the dispenser module further comprises a battery compartment located on a back side of the module.

4. The automatic electronic dispenser of claim 1 wherein the dispenser module further comprises a plurality of frame parts and a plurality of mounts for attaching the plurality of pressing rollers to the frame parts.

5. The automatic electronic dispenser of claim 1 wherein the driving roller and the plurality of pressing rollers comprise a plurality of spaced-apart ridges on a periphery of each roller.

6. The automatic electronic dispenser of claim 1 wherein the dispenser module further comprises a static release.

7. The automatic electronic dispenser of claim 1 wherein the paper product comprises rolled tissue paper.

8. The automatic electronic dispenser of claim 1 wherein the paper product comprises flexible sheet material.

9. The automatic electronic dispenser of claim 1 wherein the electronic sensor is located on a bottom side of the dispenser module for detecting the proximity of a user.

10. The automatic electronic dispenser of claim 1 further comprising a front cover hinged on each side to rotate to an open position for loading a paper roll.

11. The automatic electronic dispenser of claim 1 further comprising a back cover for mounting the electronic dispenser to a vertical surface.

12. The automatic electronic dispenser of claim 1 wherein the pressing rollers continue to feed the paper if the paper breaks between the pressing rollers as the paper is being dispensed.

13. An automatic electronic dispenser for dispensing a roll of tissue paper from the roll through a discharge chute, comprising:

a paper roll holder attached to the sides of the dispenser;

a driving roller for unrolling the paper from the paper holder in response to a signal from an electronic sensor; and a pair of pressing rollers pivotally mounted in a parallel stacked arrangement defining a substantially unitary structure that is pivotable about a common axis, each of the pressing rollers arranged adjacent the driving roller and engaging the driving roller in biased engagement so as to feed the paper along a path between the pressing and driving rollers and therewith through the discharge chute;

wherein the pair of pressing rollers are pivotable together about the common axis such that as one of the pressing rollers is pivoted away from the driving roller, another one of the pressing rollers is pivoted toward the driving roller.

14. The automatic electronic dispenser of claim 13 wherein the pressing rollers comprise spring-loaded plastic rollers.

15. The automatic electronic dispenser of claim 13 wherein the dispenser further comprises a battery compartment located on a back side of the dispenser.

16. The automatic electronic dispenser of claim 13 wherein the dispenser further comprises a plurality of frame parts and a plurality of mounts for attaching the plurality of pressing rollers to the frame parts.

17. The automatic electronic dispenser of claim 13 wherein the driving roller and the plurality of pressing rollers comprise a plurality of spaced-apart ridges on a periphery of each roller.

18. The automatic electronic dispenser of claim 13 wherein the dispenser further comprises a static release.

19. The automatic electronic dispenser of claim 13 wherein the electronic sensor is located on a bottom side of the dispenser for detecting the proximity of a user.

20. The automatic electronic dispenser of claim 13 wherein the pressing rollers continue to dispense the tissue paper if the tissue paper breaks between the pressing rollers as the tissue paper is being dispensed.

21. An automatic electronic dispenser for dispensing a roll of tissue paper, comprising:

a dispenser module for driving tissue from the roll through a discharge chute at the bottom of the module, the dispenser module having a front portion that is pivotable about a hinge, the dispenser module including:

a paper roll holder attached to the sides of the dispenser module;

a driving roller for unrolling the tissue from the paper holder in response to a signal from an electronic sensor; and a plurality of pressing rollers including an upper pressing roller and a lower pressing roller mounted in a vertically stacked, parallel configuration and pivotable as a substantially unitary structure about a common axis, the pressing rollers each frictionally contacting the driving roller so as to rotate therewith to dispense the tissue along a path between the pressing and driving rollers to the discharge chute, and wherein as the substantially unitary structure rotates about the common axis, the lower roll is pivoted away from the driving roller, and the upper pressing roll is pivoted into closer frictional contact with the driving roller.

22. The automatic electronic dispenser of claim 21 further comprising a front cover hinged on each side to rotate to an open position for loading a roll of tissue paper, and wherein the front portion of the dispenser module pivots forward about the hinge when the front cover of the electronic dispenser is opened.

23. The automatic electronic dispenser of claim 22 wherein the front portion of the dispenser module pivots rearward about the hinge when the front cover of the electronic dispenser is closed.

24. The automatic electronic dispenser of claim 22 wherein the pivoting forward of the front portion of the dispenser module reduces a requirement for having tight tolerances between the driving roller and the pressing rollers.

25. The automatic electronic dispenser of claim 21 wherein the driving roller and the plurality of pressing rollers comprise a plurality of spaced-apart ridges on a periphery of each roller.

26. The automatic electronic dispenser of claim 21 wherein the pressing rollers comprise spring-loaded plastic rollers.

27. The automatic electronic dispenser of claim 21 wherein the pressing rollers continue to feed the tissue if the tissue breaks between pressing rollers as the tissue is being dispensed.

28. An intelligent dispensing system for automatically dispensing and monitoring usage of a paper product, comprising:

a plurality of dispensers, each dispenser having a dispenser module for driving paper from a roll of the paper product through a discharge chute, the dispenser module including:

a driving roller for unrolling the paper from a paper roll holder in response to a signal from an electronic sensor; and a plurality of pressing rollers, the pressing rollers engaging the driving roller so as to engage the paper therebetween for dispensing the paper along a path between the pressing and driving rollers to a discharge chute, wherein the pressing rollers are independently rotatable and are mounted for common rotation about a pivot axis such that one of the pressing rollers to moves toward tighter engagement with the driving roller as another one of the pressing rollers is moved away from the driving roller.

29. The intelligent dispensing system of claim 28 wherein each dispenser further comprises a microprocessor controller and a transceiver.

30. The intelligent dispensing system of claim 29 further comprising:

a master network device operatively connected with the transceiver in each dispenser; and a local network for enabling a paper product status message to be transmitted from each dispenser to the master network device.

31. The intelligent dispensing system of claim 30 further comprising an automation and control network interoperable with the local network for monitoring a status of each dispenser.

32. The intelligent dispensing system of claim 31 wherein the master network device transmits status messages over the automation and control network.

33. The intelligent dispensing system of claim 31 wherein the automation and control network uses a building automation and control network protocol.

34. The intelligent dispensing system of claim 30 wherein the master network device receives status messages from the transceiver in each dispenser.

35. The intelligent dispensing system of claim 30 wherein each dispenser and the master network device communicate with each other using wireless signals.

36. The intelligent dispensing system of claim 30 wherein the master network device and each dispenser transceiver use a wired connection for communication.

37. The intelligent dispensing system of claim 30 wherein the local network uses a data communications protocol.

38. The intelligent dispensing system of claim 30 further comprising a handheld device for data communications with the master network device.

39. The intelligent dispensing system of claim 29 wherein the microprocessor controller for each dispenser determines an amount of paper remaining on the paper roll holder and transmits a status message signal containing a status of the paper product to the master network device.

40. The automatic electronic dispenser of claim 28 wherein the pressing rollers comprise spring-loaded plastic rollers.

41. The automatic electronic dispenser of claim 28 wherein the driving roller and the plurality of pressing rollers comprise a plurality of spaced-apart ridges on a periphery of each roller.

42. The automatic electronic dispenser of claim 28 wherein the pressing rollers continue to feed the paper if the paper breaks between the pressing rollers as the paper is being dispensed.

43. A dispenser module for an automatic electronic dispenser for dispensing a roll of perforated paper mounted on a paper holder, comprising:

a driving roller for unrolling the perforated paper from the paper holder in response to a signal from a proximity sensor; and dual pressing rollers, including a top roller arranged above and parallel to a lower roller, the pressing rollers being substantially independently rotatable and each substantially simultaneously engaging the driving roller with the perforated paper in driven contact therebetween for dispensing the perforated paper along a path between the pressing and driving rollers to a discharge chute;

wherein the dual pressing rollers are pivotally mounted for rotation about a common pivot axis, wherein the top roller is pivoted toward the driving roller as the lower roller is pivoted away from the driving roller to substantially maintain contact of the perforated paper between the driving roll and at least one of the pressing rollers.

44. The dispenser module of claim 43 wherein the pressing rollers comprise spring-loaded plastic rollers.

45. The dispenser module of claim 43 wherein the driving roller and the plurality of pressing rollers comprise a plurality of spaced-apart ridges on a periphery of each roller.

46. The automatic electronic dispenser of claim 43 wherein the pressing rollers continue to feed the paper if the paper breaks between the pressing rollers as the paper is being dispensed.

47. An automatic dispenser for dispensing a roll of paper, comprising:

a paper holder connected to at least a portion of the automatic dispenser, the paper holder at least partially supporting the roll of paper;

a driving roller that dispenses paper from the roll of paper in response to a signal from an electronic sensor;

a frame arranged substantially adjacent to the driving roller; and a plurality of pressing rollers connected to the frame by one or more mounts defining a substantially unitary structure that is pivotable about an axis, and wherein the plurality of pressing rollers are disposed along the driving roller so as to at least partially define a path between the pressing rollers and the driving roller for guiding the paper toward a discharge chute, wherein the plurality of pressing rollers comprises a first pressing roller and a second pressing roller each connected to and biased by a respective biasing member, and wherein the first and second pressing rollers pivot about the axis to maintain substantially continuous contact with the paper to prevent at least partial tearing of one or more perforated portions defined in the paper.

* * * * *